US008717266B2

(12) United States Patent
Matsushima et al.

(10) Patent No.: US 8,717,266 B2
(45) Date of Patent: May 6, 2014

(54) LIQUID CRYSTAL DISPLAY DEVICE, AND ELECTRONIC DEVICE COMPRISING SAME

(75) Inventors: Jin Matsushima, Kawasaki (JP); Michiaki Sakamoto, Kawasaki (JP); Ken Sumiyoshi, Kawasaki (JP); Kenichi Mori, Kawasaki (JP)

(73) Assignee: NLT Technologies, Ltd., Kanagawa (JP)

( * ) Notice: Subject to any disclaimer, the term of this patent is extended or adjusted under 35 U.S.C. 154(b) by 763 days.

(21) Appl. No.: 12/726,696

(22) Filed: Mar. 18, 2010

(65) Prior Publication Data

US 2010/0238105 A1 Sep. 23, 2010

(30) Foreign Application Priority Data

Mar. 18, 2009 (JP) ..... 2009-066285

(51) Int. Cl.
*G09G 3/36* (2006.01)

(52) U.S. Cl.
USPC ..... 345/87; 349/119

(58) Field of Classification Search
USPC ..... 345/84, 87, 100, 102, 119
See application file for complete search history.

(56) References Cited

U.S. PATENT DOCUMENTS

| | | | | |
|---|---|---|---|---|
| 7,502,085 | B2 * | 3/2009 | Hirai | 349/117 |
| 2002/0054256 | A1 * | 5/2002 | Kim et al. | 349/113 |
| 2003/0052869 | A1 * | 3/2003 | Fujii et al. | 345/204 |
| 2005/0237450 | A1 * | 10/2005 | Hu et al. | 349/108 |
| 2007/0046606 | A1 * | 3/2007 | Kim et al. | 345/90 |
| 2008/0123000 | A1 * | 5/2008 | Lin et al. | 349/33 |

FOREIGN PATENT DOCUMENTS

| | | | |
|---|---|---|---|
| JP | 7-69548 | B2 | 12/1990 |
| JP | 11305248 | A | 11/1999 |
| JP | 2002-162940 | A | 6/2002 |
| JP | 2004-056496 | A | 2/2004 |
| JP | 200469926 | A | 3/2004 |
| JP | 2004-170792 | A | 6/2004 |
| JP | 2004-177591 | A | 6/2004 |
| JP | 2004226957 | A | 8/2004 |
| JP | 200524680 | A | 1/2005 |
| JP | 2007133443 | A | 5/2007 |
| JP | 2007537475 | A | 12/2007 |

OTHER PUBLICATIONS

Office Action dated Mar. 5, 2013 issued by the Japanese Patent Office in counterpart Japanese Application No. 2009-066285.
Chinese Office Action dated Sep. 17, 2013 issued in corresponding Chinese Patent Application No. 201010143427.9.

* cited by examiner

*Primary Examiner* — Pegeman Karimi
(74) *Attorney, Agent, or Firm* — Sughrue Mion, PLLC

(57) ABSTRACT

A liquid crystal display device comprises a liquid crystal panel including sub-pixels and a back light for irradiating light to the back surface of liquid crystal panel. A transmission sub-pixel can be switched into an image display state which can allow irradiated light to exit, and a black display state which does not allow irradiated light to exit. A mirror sub-pixel can be switched between a mirror state which can allow reflected light to exit and a non-mirror state which does not allow reflected light to exit, independently of the transmission sub-pixel. A control unit places each transmission sub-pixel into the image display state or black display state, and places each mirror sub-pixel into the mirror state or non-mirror state.

9 Claims, 22 Drawing Sheets

LIQUID CRYSTAL DISPLAY DEVICE, AND ELECTRONIC DEVICE COMPRISING SAME

This application is based upon and claims the benefit of priority from Japanese patent application No. 2009-66285, filed on Mar. 18, 2009, the disclosure of which is incorporated herein in its entirety by reference.

BACKGROUND OF THE INVENTION

1. Field of the Invention

The present invention relates to a transflective liquid crystal display device, an electronic device comprising the same, and a controller for a transflective liquid crystal display device.

2. Description of the Related Art

A transflective liquid crystal display device is one type of liquid crystal display device, and some transflective liquid crystal display devices are capable of switching between a display mode for displaying an image on a screen and a mirror mode for placing the screen into a mirror state. Such a liquid crystal display excels not only in practicability but also in decorativeness.

Also, liquid crystal display devices may conform to several display modes such as TN (Twisted Nematic) scheme, ECB (Electrically Controlled Birefringence) scheme, VA (Vertical Alignment) scheme, IPS (in Plane Switching) scheme, and the like.

JP2004-170792A describes a TN-based transflective liquid crystal display device and an ECB-based transflective liquid crystal display device.

The TN-based liquid crystal display device described in JP2004-170792A will be described with reference to FIGS. 1 and 2. FIGS. 1 and 2 are cross-sectional views generally showing the configuration of the liquid crystal display device in its thickness direction.

Referring first to FIG. 1, a description will be given of the configuration of the liquid crystal display device. This liquid crystal display device comprises liquid crystal panel 920 for displaying an image, and back light 970 which is a light source for irradiating light onto a bottom surface of liquid crystal panel 920. With this liquid crystal display device, a user can observe liquid crystal panel 920 as a screen from above liquid crystal panel 920.

Liquid crystal panel 920 comprises upper substrate 930 and lower substrate 950 which are arranged in opposition to each other. Upper substrate 930 is provided with polarizer plate 910 on its top surface, while lower substrate 950 is provided with polarizer plate 960 on its bottom surface.

Coloring layer 941*a* covered with protection film 941*b* is disposed on the bottom surface of upper substrate 930, and common electrode 942 is disposed on a bottom surface of protection film 941*b*. On the top surface of lower substrate 950, in turn, reflector plate 945 is disposed, where openings 949 are sequentially formed side by side through reflector plate 945. Electrodes 944 are disposed on the top surface of reflector plate 945 and in openings 949.

Liquid crystal layer 943 filled with liquid crystal is interposed between upper substrate 930 and lower substrate 950. When no voltage is applied between common electrode 942 and electrode 944, liquid crystal layer 943 is oriented in twisted alignment where liquid crystal molecules sequentially twist by 90 degrees between substrates 930 and 950, causing the direction of linearly polarized light, which is transmitted through liquid crystal layer 943, to rotate by 90 degrees. On the other hand, when a sufficient voltage is applied between common electrode 942 and electrode 944, liquid crystal layer 943 is such that liquid crystal molecules are aligned vertically with respect to substrates 930, 950, causing no change in the polarization state of the linearly polarized light which is transmitted through liquid crystal layer 943. Here, a "non-voltage applied state" refers to a state where no voltage is applied between common electrode 942 and electrode 944, while a "voltage applied state" refers to a state where a sufficient voltage is applied between common electrode 942 and electrode 944.

Coloring layer 941*a* is disposed at a position opposite to opening 949. Coloring layer 941*a* is a layer which colors light irradiated from back light 970 in one of red (R), green (G), and blue (B) by allowing the light to be transmitted through coloring layer 941*a* upward from blow.

Accordingly, as light irradiated from back light 970 passes through opening 949 in the display mode, the light is transmitted through coloring layer 941*a* and is thereby colored. In this way, this liquid crystal display device can display a color image on the screen because it can emit colored light upward through liquid crystal panel 920.

In the mirror mode, on the other hand, external light incident on the liquid crystal display device from above polarizer plate 910 is reflected by reflector plate 945, and the reflected light is emitted upward from polarizer plate 910. In this way, liquid crystal panel 920 appears like a mirror, as viewed from above, in the mirror mode. In this regard, since the external light incident on polarizer plate 910 is not transmitted through coloring layer 941*a* in a process where it is reflected by reflector plate 945 and emitted from polarizer plate 910, the reflected light is emitted without being colored.

Referring next to FIG. 2, a description will be given of the operation of the TN-based liquid crystal display device. Polarizer plate 910 and polarizer plate 960 are disposed such that their polarization transmission axes are orthogonal to each other. Specifically, polarizer plate 910 exhibits a polarization transmission axis in a direction parallel to the drawing sheet of FIG. 2 as indicated by circled arrows in FIG. 2, while polarizer plate 960 exhibits a polarization transmission axis in a direction perpendicular to the drawing sheet as indicated by a circled mark "X."

In the non-voltage applied state of this liquid crystal display device, arrow 801 indicates a trajectory of light irradiated from back light 970, and arrow 802 indicates a trajectory of external light which incident on polarizer plate 910 from above. As indicated by the arrows, polarizer plate 910 is transmitted by the light irradiated from back light 970, and is also transmitted by the external light which is incident on polarizer plate 910 from above and reflected by reflector plate 945.

In the voltage applied state of this liquid crystal display device, on the other hand, arrow 804 indicates a trajectory of light irradiated from back light 970, and arrow 803 indicates a trajectory of external light incident on polarizer plate 910 from above. As indicated by these arrows, the light emitted from back light 970 is not transmitted through polarizer plate 910 but is absorbed by polarizer plate 910, while the external light incident on polarizer plate 910 from above and reflected by reflector plate 945 is transmitted through polarizer plate 910.

In this liquid crystal display device, since the light irradiated from back light 970 is allowed to be transmitted through polarizer plate 910 upward by placing the device into the non-voltage applied state, the liquid crystal display device can be set to the display mode where an image can be displayed on the screen. On the other hand, in this liquid crystal display device, since the external light reflected by reflector plate 945 is allowed to be transmitted through polarizer plate 910 upwards, while the light irradiated from back light 970 is not allowed to be transmitted through polarizer plate 910 upwards, by placing the device into the voltage applied state, the liquid crystal display device can be set to the mirror mode where the screen can be used as a mirror.

Referring next to FIGS. 3 and 4, a description will be given of an ECB-based liquid crystal display device described in JP2004-170792A. FIGS. 3 and 4 are schematic diagrams showing the configuration of this liquid crystal display device.

Referring first to FIG. 3, a description will be given of the configuration of the liquid crystal display device. This liquid crystal display device is constructed in a similar manner to the TN-based liquid crystal display device shown in FIGS. 1 and 2 except that liquid crystal panel 920*a* is provided with first λ/4 plate 918, second λ/4 plate 919, and insulating layer 990, and that liquid crystal molecules are oriented in twisted alignment where they sequentially twist between substrates 930 and 950 by a value which is set in a range of zero to 90 degrees. In FIGS. 3 and 4, components common to FIGS. 1 and 2 are designated the same reference numerals.

λ/4 plate 918 is disposed between upper substrate 930 and polarizer plate 910, while λ/4 plate 919 is disposed between lower substrate 950 and polarizer plate 960. Also, insulating layer 990 is disposed between lower substrate 950 and reflector plate 945 in order to position a reflecting surface of reflector plate 949 at the center of liquid crystal layer 943 in a thickness direction. λ/4 plate 918 and λ/4 plate 919 are wavelength plates for transforming linearly polarized light into circularly polarized light and transforming circularly polarized light into linearly polarized light.

Referring next to FIG. 4, a description will be given of the operation of this ECB-based liquid crystal display device.

In the non-voltage applied state of the liquid crystal display device, arrow 805 indicates a trajectory of light irradiated from back light 970, while arrow 806 indicates a trajectory of external light incident on polarizer plate 910 from above. In this way, polarizer plate 910 is transmitted by the light irradiated from back light 970, and is also transmitted by the external light which is incident on polarizer plate 910 from above and reflected by reflector plate 945.

In the voltage applied state of the liquid crystal display device, arrow 808 indicates a trajectory of light irradiated from back light 970, while arrow 807 indicates a trajectory of external light incident on polarizer plate 910 from above. In this way, the light irradiated from back light 970 is not transmitted through polarizer plate 910 but is absorbed by polarizer plate 910, and the external light incident on polarizer plate 910 from above and reflected by reflector plate 945 is not transmitted through polarizer plate 910 but is absorbed by polarizer plate 910.

In this liquid crystal display device, since the light irradiated from back light 970 is allowed to be transmitted through liquid crystal panel 920*a* upward by placing the device into the non-voltage applied state, the liquid crystal display device can be set to the display mode where an image can be displayed on the screen. On the other hand, in this liquid crystal display device, since the external light reflected by reflector plate 945 alone is allowed to be transmitted through liquid crystal panel 920*a* upward by placing the device into the non-voltage applied state, and turning off back light 805, the liquid crystal display device can be set to the mirror state where the screen can be used as a mirror.

In the TN-based liquid crystal display device shown in FIGS. 1 and 2, when a black character is displayed on a white background, for example, in the display mode, the voltage applied state is set in those pixels which display the black character, to prevent the light irradiated from back light 970 from being transmitted through liquid crystal panel 920 upwards. However, in the voltage applied state, reflected light reflected by reflector plate 945 is also emitted through liquid crystal panel 920 upward. Therefore, in a bright place such as outdoors on a clear day, the pixels which display the black character are observed to be bright by the user due to the reflected light from reflector plate 945, so that the contrast of the black character appears to be lower with respect to the white background. For this reason, this liquid crystal display suffers from lower visibility in bright places.

The ECB-based liquid crystal display device shown in FIGS. 3 and 4 is free from lower visibility as described above because neither irradiated light from back light 970 nor reflected light from reflector plate 945 are allowed to exit through liquid crystal panel 920*a* upwards in the voltage applied state. However, in this liquid crystal display device, reflected light from reflector plate 945 is also allowed to exit through liquid crystal panel 920*a* upwards in the display mode, so that the reflected light, not colored, mixes with colored irradiated light from back light 970 when a color image is displayed. Consequently, this liquid crystal display device suffers from lower saturation when an image is displayed in color.

SUMMARY OF THE INVENTION

It is an object of the present invention to provide a liquid crystal display device which is capable of switching between a display mode and a mirror mode, and which can ensure a high image quality in a display mode, an electronic device comprising the same, and a controller for a liquid crystal display device.

A liquid crystal display device according to the present invention comprises comprising:

a liquid crystal panel including a transmission section and a mirror section in each pixel;

a light source for directing light irradiated thereby into said liquid crystal panel; and a control unit for controlling said transmission section and said mirror section, wherein said transmission section can be switched between an image display state which can allow the irradiated light to exit and a black display state which does not allow the irradiated light to exit, said mirror section includes a reflection member having a flat surface, and can be switched between a mirror state which can allow incident light reflected by said reflection member to exit, and a non-mirror state which does not allow the reflected light to exit, independently of said transmission section, and said control unit places said each transmission section into either the image display state or the black display state, and places said each mirror section into either the mirror state or the non-mirror state.

BRIEF DESCRIPTION OF THE DRAWINGS

The above and other objects, features and advantage of the present invention will become apparent from the following description with reference to the accompanying drawings which illustrate examples of the present invention.

DESCRIPTION OF THE EXEMPLARY EMBODIMENTS

Next, embodiments of the present invention will be described with reference to the drawings.

(First Embodiment)

Figure 5:
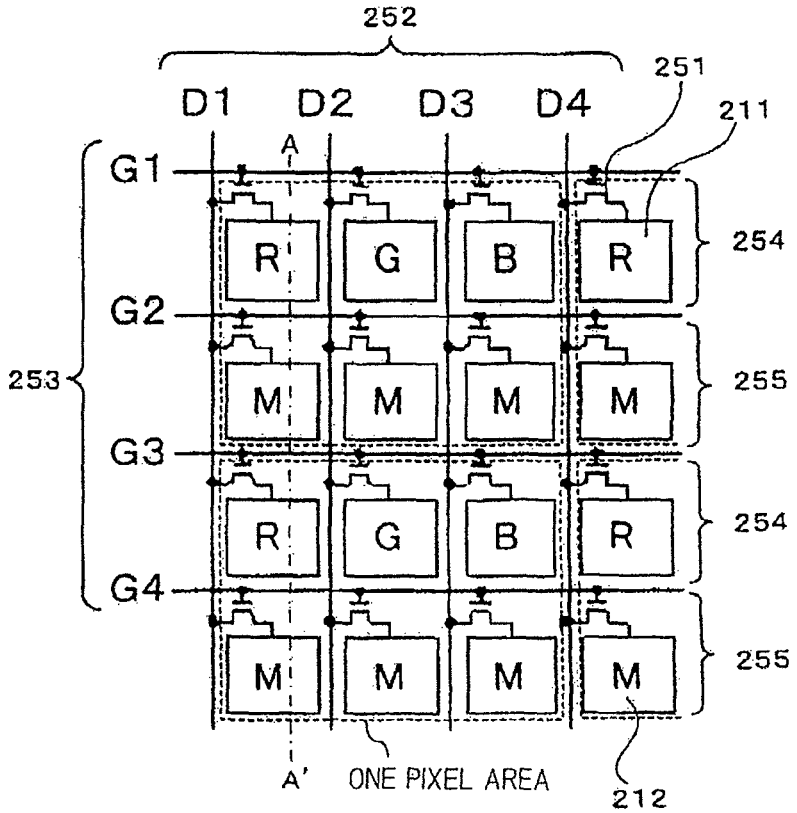
FIG. 5 is a schematic diagram showing the configuration of circuits in a liquid crystal display device according to a first embodiment of the present invention.

FIG. 5 is a schematic diagram showing the configuration of circuits in a liquid crystal display device according to a first embodiment of the present invention. This liquid crystal display device comprises two types of sub-pixels: transmission sub-pixels 254 which is a transmission area that allows light irradiated from a back light to be transmitted, and mirror sub-pixel 255 which is a mirror area that reflects external light to produce a mirror state. In this liquid crystal display device, one pixel is made up of a plurality of transmission sub-pixels 254 and a plurality of mirror sub-pixels 255.

The liquid crystal display device according to this embodiment is characterized in that each transmission sub-pixel 254 and each mirror sub-pixel 255 can be controlled independently, as will be later described in detail. In this way, this liquid crystal display device can realize a screen mode in which a display mode and a mirror mode can be mixed on a single screen.

In this embodiment, each transmission sub-pixel 254 and each mirror sub-pixel 255 are controlled independently in an active matrix scheme. The active matrix scheme refers to a scheme for controlling the driving of each sub-pixel using a switching element such as a thin-film transistor (TFT) included in each sub-pixel.

Transmission sub-pixels 254 and mirror sub-pixels 255 are arrayed to form a plurality of rows, each of which comprises one of transmission sub-pixels 254 and mirror sub-pixels 255 arranged in a line in the horizontal direction, where rows of transmission sub-pixels 254 and mirror sub-pixels 255 alternate with each other in the array. Accordingly, when the sub-pixels of the liquid crystal display device are viewed as columns in the vertical direction, rather than as rows in the horizontal direction, transmission sub-pixels 254 and mirror sub-pixels 255 alternate with each other.

Each transmission sub-pixel 254 is provided with transmission sub-pixel electrode 211, while each mirror sub-pixel 255 is provided with mirror sub-pixel electrode 212.

This liquid crystal display device is provided with drain line 252 which is a signal line extending in the vertical direction along each column of the sub-pixels. Here, Dn designates drain line 252 which corresponds to a sub-pixel on an n-th column. Specifically, drains lines 252 corresponding to sub-pixels on the first column, second column, third column, and fourth column from the left in FIG. 5 are designated by D1, D2, D3, and D4, respectively.

Also, this liquid crystal display device is provided with gate line 253 which is a scan line extending in the horizontal direction along each row of the sub-pixels. Here, Gn designates gate line 253 corresponding to a sub-pixel on an n-th row. Specifically, gate lines 253 corresponding to sub-pixels on the first row, second row, third row, and fourth row from the top in FIG. 5 are designated by G1, G2, G3, and G4, respectively.

Each of transmission sub-pixel 254 and mirror sub-pixel 255 is individually provided with TFT 251 near the intersection of drain line 252 with gate line 253, and TFT 251 is connected to sub-pixel electrode 211, 212, respectively, provided in each sub-pixel. TFT 251 is also connected to drain line 252 and gate line 253 corresponding to each sub-pixel 254, 255. Each TFT 251 is controlled by a signal supplied to gate line 253 connected thereto.

In this way, each sub-pixel 254, 255 can be controlled through drain line 252 and gate line 253 corresponding thereto in an active matrix scheme. Specifically, transmission sub-pixel 254 appearing at the upper leftmost corner in FIG. 5, for example, is controlled through drain line D1 and gate line G1, and mirror sub-pixel 255 immediately below transmission sub-pixel 254 is controlled through drain line D1 and gate line G2.

Figure 6:
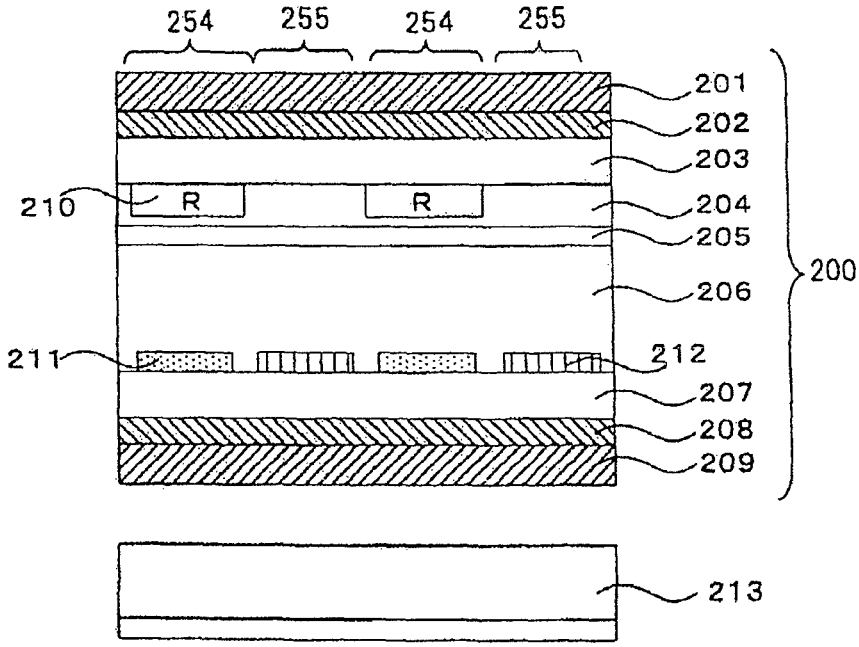
FIG. 6 is a cross-sectional view of the liquid crystal display device shown in FIG. 5, taken along line A-A'.

FIG. 6 is a cross-sectional view of the liquid crystal display device shown in FIG. 5, taken along line A-A'. Specifically, FIG. 6 shows sub-pixels on the first column of the liquid crystal display device in FIG. 5. As can be seen, gate line 253 is omitted in FIG. 6. This liquid crystal display device comprises liquid crystal panel 200 for displaying an image, and back light 213 which is a light source for irradiating liquid crystal panel 200 with light from below, as viewed in FIG. 6. Here, the top surface of liquid crystal panel 200 is defined as a front surface, and the bottom surface of the liquid crystal panel 200 is defined as a back surface. This liquid crystal display device permits the user to observe liquid crystal panel 200 as a screen from the front surface side of liquid crystal panel 200.

Liquid crystal panel 200 comprises upper substrate 203 and lower substrate 207 arranged in opposition to each other. λ/4 plate 202 is disposed on the top surface of upper substrate 203, and polarizer plate 201 is disposed on the top surface of λ/4 plate 202. Similarly, λ/4 plate 208 is disposed on the bottom surface of lower substrate 207, and polarizer plate 209 is disposed on the bottom surface of λ/4 plate 208.

Coloring layer 210 covered with protection film 204 is disposed on the bottom surface of upper substrate 203, and common electrode 205 is disposed on a bottom surface of protection film 204. Also, transmission sub-pixel electrodes 211 and mirror sub-pixel electrodes 212 are alternately disposed on the top surface of lower substrate 207. Mirror sub-pixel electrode 212 is formed of a material which exhibits a high reflectivity such that its top surface is even, and therefore functions not only as an electrode but also as a reflection member for reflecting external light incident thereon from above.

Liquid crystal layer 206 is also disposed between upper substrate 203 and lower substrate 207. Liquid crystal layer 206 is filled with liquid crystal which is aligned in a direction perpendicular to the surfaces of the respective substrates. Voltage can be individually applied between each sub-pixel electrode 211, 212 and common electrode 205, so that liquid crystal layer 206 can be applied with different voltages for each sub-pixel 254, 255.

This liquid crystal display device employs a display scheme called "VA scheme." Liquid crystal layer 206 is such that liquid crystal molecules align in the direction perpendicular to substrates 203, 207 in a non-voltage applied state where no voltage is applied between sub-pixel electrode 211, 212 and common electrode 205, to give no phase difference to light which is transmitted through liquid crystal layer 206 in the thickness direction. On the other hand, in a voltage applied state where a predetermined voltage is applied between common electrode 205 and sub-pixel electrode 211, 212, liquid crystal layer 206 is such that liquid crystal molecules align in a direction inclined from the direction perpendicular to substrates 203, 207, giving a predetermined phase difference to light which is transmitted through liquid crystal layer 206 in the thickness direction.

Coloring layer 210 is disposed at a position opposite to transmission sub-pixel electrode 211. Accordingly, as light is transmitted through transmission sub-pixel electrode 211 and is transmitted through coloring layer 210, the light is colored in a color according to coloring layer 210. Transmission sub-pixels 254 comprise those for displaying red, those for displaying green, and those for displaying blue, and coloring layer 210 used in each transmission sub-pixel 254 corresponds to a color to be displayed.

In FIG. 5, "R" represents transmission sub-pixel 254 for displaying red; "G" represents transmission sub-pixel 254 for displaying green; and "B" represents transmission sub-pixel 254 for displaying blue. As shown in FIG. 5, colors displayed by transmission sub-pixels 254 are red on the first column, green on the second column, and blue on the third column, and are arranged in the order of red, green, and blue on the fourth column onward. As can be seen, mirror sub-pixels 255 are all labeled "M" in FIG. 5.

In this liquid crystal display device, one pixel is made up of six sub-pixels indicated by a broken line which surrounds them in FIG. 5. Specifically, one pixel includes transmission sub-pixels 254 each for displaying red, blue, and green, and three mirror sub-pixels 255.

Figure 7A:
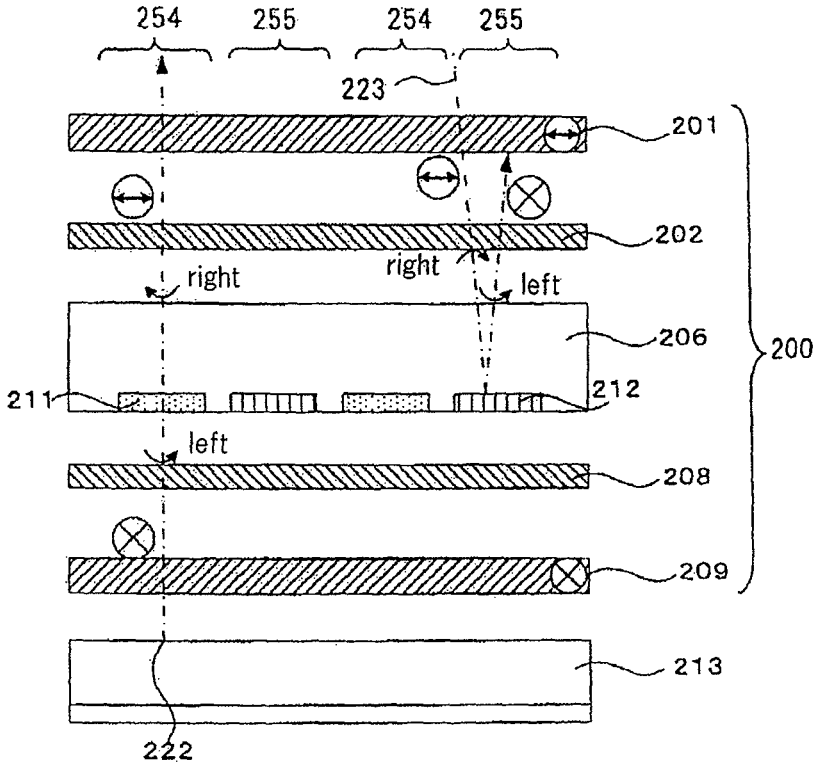
FIG. 7A is a schematic diagram indicating trajectories of light in the liquid crystal display device shown in FIG. 5.

FIG. 7A is a diagram indicating trajectories of light in the display mode of the liquid crystal display device. Polarizer plate 201 and polarizer plate 209 are disposed such that their polarization transmission axes are orthogonal to each other. Specifically, polarizer plate 201 exhibits a polarization transmission axis in a direction parallel to the drawing sheet of FIG. 7A as indicated by circled arrows in FIG. 7A, while polarizer plate 209 exhibits a polarization transmission axis in a direction perpendicular to the drawing sheet as indicated by a circled mark "X."

In transmission sub-pixel 254 in the display mode, the absolute value of voltage applied to liquid crystal layer 206 should be chosen to be equal to or higher than a voltage value at which transmission sub-pixel 254 enters a non-voltage applied state, i.e., 0 V or higher, and equal to or lower than a voltage value at which light is maximally emitted. Also, in mirror sub-pixel 254 in the display mode, no voltage is applied to liquid crystal layer 206, so that mirror sub-pixel 254 remains in the non-voltage applied state.

FIG. 7A shows, by way of example, that transmission sub-pixel 254 is in a voltage applied state. In his voltage applied state of the liquid crystal display device in the display mode, voltage applied between common electrode 205 and transmission sub-pixel electrode 211 is set such that light transmitting liquid crystal layer 206 is given a phase difference of $\lambda/2$.

In the display mode of the liquid crystal display device, arrow 222 indicates a trajectory of light irradiate from back light 213 to transmission sub-pixel 254 in the voltage applied state, and arrow 223 indicates a trajectory of external light incident on mirror sub-pixel 255 in the non-voltage applied state. In this way, polarizer plate 201 is transmitted by the light irradiated from back light 213 to transmission sub-pixel 254 in the voltage applied state, but is not transmitted by the external light incident on mirror sub-pixel 255 in the non-voltage applied state and is reflected by mirror sub-pixel electrode 212.

Accordingly, in the display mode of the liquid crystal display device, transmission sub-pixel 254 is placed into an image display state where the irradiated light incident on transmission sub-pixel 254 can be allowed to exit from the front surface of liquid crystal panel 200, while mirror sub-pixel 254 is placed into a non-mirror state where the external light reflected by mirror sub-pixel electrode 212 is not allowed to exit from the front surface of liquid crystal panel 200.

As described above, in the display mode of the liquid crystal display, transmission sub-pixel 254 is placed into the image display state, while mirror sub-pixel 255 is placed into the non-mirror state, thereby allowing only the light that is transmitted by transmission sub-pixel 254 to exit from the front surface of liquid crystal panel 200, but not allowing the reflected light from mirror sub-pixel 255 to exit. Consequently, this liquid crystal display device can ensure high visibility of image in the display mode, even if it is used in a bright environment, because the image is not degraded in contrast due to the reflected light from mirror sub-pixel 255.

Figure 7B:
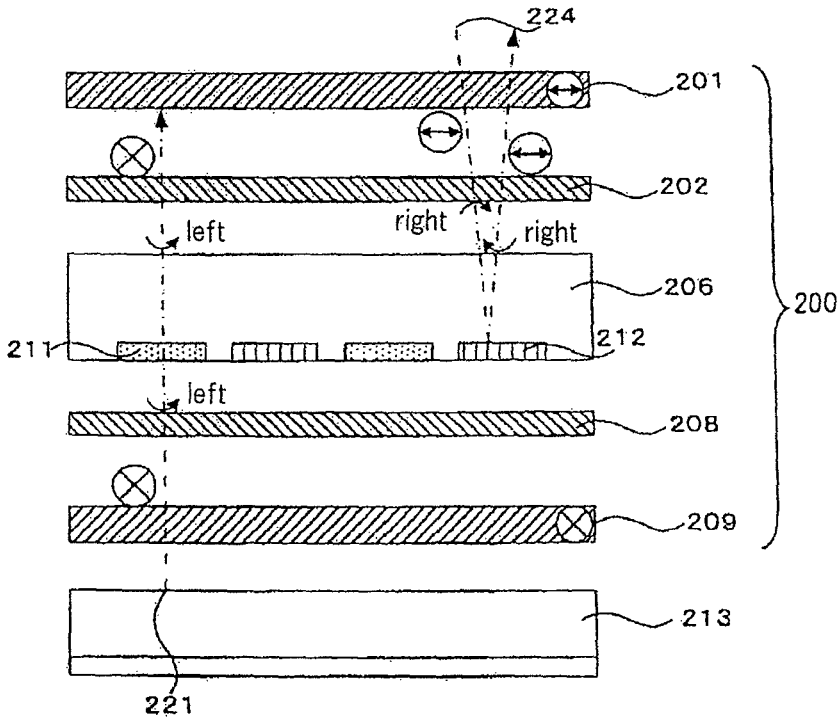
FIG. 7B is a schematic diagram indicating trajectories of light in the liquid crystal display device shown in FIG. 5.

FIG. 7B is a diagram showing trajectories of light in the mirror mode of the liquid crystal display device. In the mirror mode of the liquid crystal display device, transmission sub-pixel 254 is placed into a non-voltage applied state by applying no voltage to liquid crystal layer 206. Also, in the mirror mode, mirror sub-pixel 255 is placed into a voltage applied state by applying a predetermined voltage to liquid crystal layer 206.

In the mirror mode of the liquid crystal display device, a voltage applied between common electrode 205 and mirror sub-pixel electrode 212 in the voltage applied state is set such that light transmitting liquid crystal layer 206 is given a phase difference of $\lambda/4$.

In the mirror more of the liquid crystal display device, arrow 221 indicates a trajectory of light emitted from back light 213 to transmission sub-pixel 254 in the non-voltage applied state, and arrow 224 indicates a trajectory of external light incident on mirror sub-pixel 255 in the voltage applied state. In this way, polarizer plate 201 is not transmitted by the light irradiated from back light 213 to transmission sub-pixel 254 in the non-voltage applied state, but is transmitted by the external light incident on mirror sub-pixel 255 in the non-voltage applied state and reflected by mirror sub-pixel electrode 212.

Accordingly, in the mirror mode of the liquid crystal display device, transmission sub-pixel 254 is placed into a black display state where the irradiated light incident on transmission sub-pixel 254 is not allowed to exit from the front surface of liquid crystal panel 200, while mirror sub-pixel 255 is placed into a mirror state where the external light reflected by mirror sub-pixel electrode 212 is allowed to exit from the front surface of liquid crystal panel 200.

As described above, this liquid crystal display device can be switched between the display mode and the mirror mode, and can also ensure a high image quality in the display mode.

Notably, in this liquid crystal display device, since the light irradiated from back light 213 and incident on transmission sub-pixel 254 is not emitted from the front surface of liquid crystal panel 200 in the mirror mode, back light 213 need not be switched from ON to OFF when the liquid crystal display device is switched from the display mode to the mirror mode.

In a liquid crystal display device which involves turning a back light from ON to OFF when it is switched from the display mode to the mirror mode, as the one described in JP2004-170792A, the back light is ON in the display mode, and OFF in the mirror mode. For this reason, such a liquid crystal display device experiences difficulties in realizing a screen mode for mixing the display mode and mirror mode on a single screen, though the liquid crystal display device can provide a screen mode for setting the overall screen to the display mode and a screen mode for setting the overall screen to the mirror mode.

In contrast, since back light 213 can be kept ON both in the display mode and mirror mode in the liquid crystal display device according to this embodiment, the liquid crystal display device can realize a screen mode for mixing the display mode and mirror mode on a single screen by setting a first area within the screen to the display mode and by setting a second area different from the first area within the same screen to the mirror mode, in addition to a screen mode which sets the entire screen to the display mode and a screen mode which sets the entire screen to the mirror mode. With the realization of the screen mode for mixing the display mode and mirror mode, the liquid crystal display device can be improved as regards the degree of freedom in screen layout, leading to resulting improvements in practicability and decorativeness.

FIGS. 8A-8E are diagrams illustrating the above screen mode of the liquid crystal display device. Specifically, FIGS. 8A-8E show (1) the state of transmission sub-pixel 254, (2) the state of mirror sub-pixel 255, and (3) a screen actually observed by the user.

FIGS. 8A-8E (1) show that transmission sub-pixels 254 are in an image display state within an area in which a black character "A" is displayed on a white background, and that transmission sub-pixels 254 are in a black display state within a solid black area.

FIGS. 8A-8E (2) show that mirror sub-pixels 255 are in a mirror state within a shaded area, and that mirror sub-pixels 255 are in a non-mirror state within a solid black area.

FIGS. 8A-8E (3) show that the display mode is set to an area in which a black character "A" is shown on a white background within the screen, and that the mirror mode is set to a shaded area.

Figure 8A:
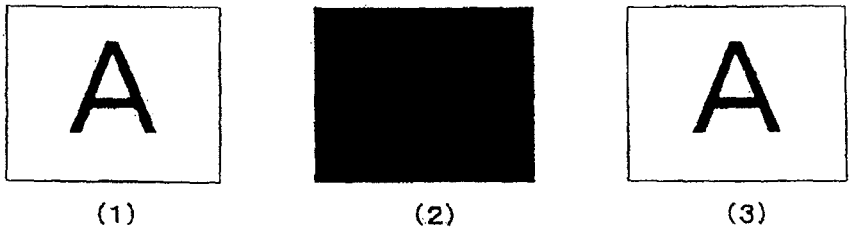
FIG. 8A is a diagram illustrating a screen mode of the liquid crystal display device shown in FIG. 5.

FIG. 8A shows a screen mode in which the entire screen is set to the display mode. In this screen mode, all transmission sub-pixels 254 are placed into an image display state, while all mirror sub-pixels 255 are placed into a non-mirror state.

Figure 8B:
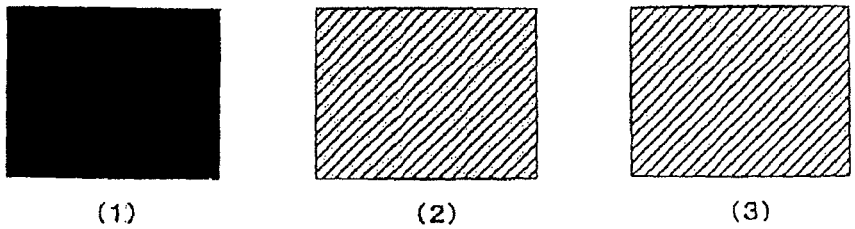
FIG. 8B is a diagram illustrating a screen mode of the liquid crystal display device shown in FIG. 5.

FIG. 8B shows a screen mode in which the entire screen is set to the mirror mode. In this screen mode, all transmission sub-pixels 254 are placed into a black display state, while all mirror sub-pixels 255 are placed into a mirror state.

Figure 8C:
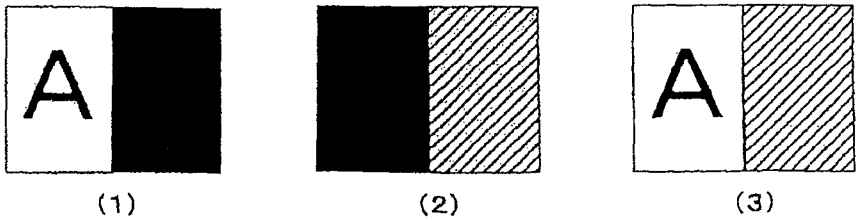
FIG. 8C is a diagram illustrating a screen mode of the liquid crystal display device shown in FIG. 5.

FIG. 8C shows a screen mode in which the display mode and mirror mode are mixed by setting the left half of the screen to the display mode and the right half of the screen to the mirror mode. In this screen mode, transmission sub-pixels 254 are placed into the image display state in the left half of the screen, while transmission sub-pixels 254 are placed into the black display state in the right half of the screen. Further, mirror sub-pixels 255 are placed into the non-mirror state in the left half of the screen, while mirror sub-pixels 255 are placed into the mirror state in the right half of the screen.

Figure 8D:
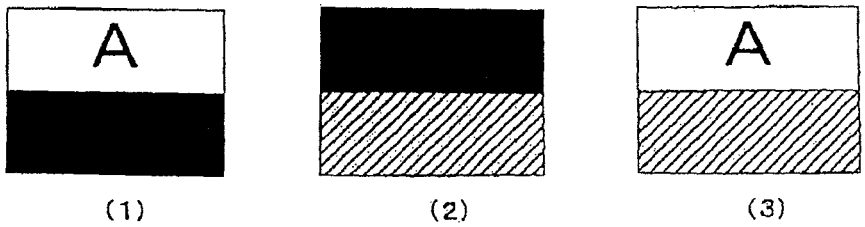
FIG. 8D is a diagram illustrating a screen mode of the liquid crystal display device shown in FIG. 5.

FIG. 8D shows a screen mode in which the display mode and mirror mode are mixed by setting the upper half of the screen to the display mode and the lower half of the screen to the mirror mode. In this screen mode, transmission sub-pixels 254 are placed into the image display state in the upper half of the screen, while transmission sub-pixels 254 are placed into the black display state in the lower half of the screen. Further, mirror sub-pixels 255 are placed into the non-mirror state in the upper half of the screen, while mirror sub-pixels 255 are placed into the mirror state in the lower half of the screen.

Figure 8E:
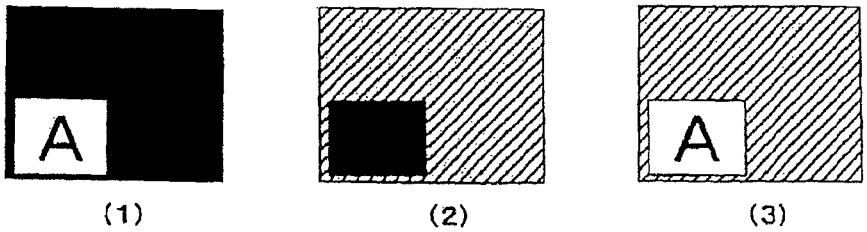
FIG. 8E is a diagram illustrating a screen mode of the liquid crystal display device shown in FIG. 5.

FIG. 8E shows a screen mode in which the display mode and mirror mode are mixed by setting a lower left area of the screen to the display mode and the remaining area of the screen except for the lower left area to the mirror mode. In this screen mode, transmission sub-pixels 254 are placed into the image display state in the lower left area of the screen, while transmission sub-pixels 254 are placed into the black display state in the remaining screen except for the lower left area. Further, mirror sub-pixels 255 are placed into the non-mirror state in the lower left area of the screen, while mirror sub-pixels 255 are placed into the mirror state in the remaining area of the screen except for the lower left area.

Figure 9:
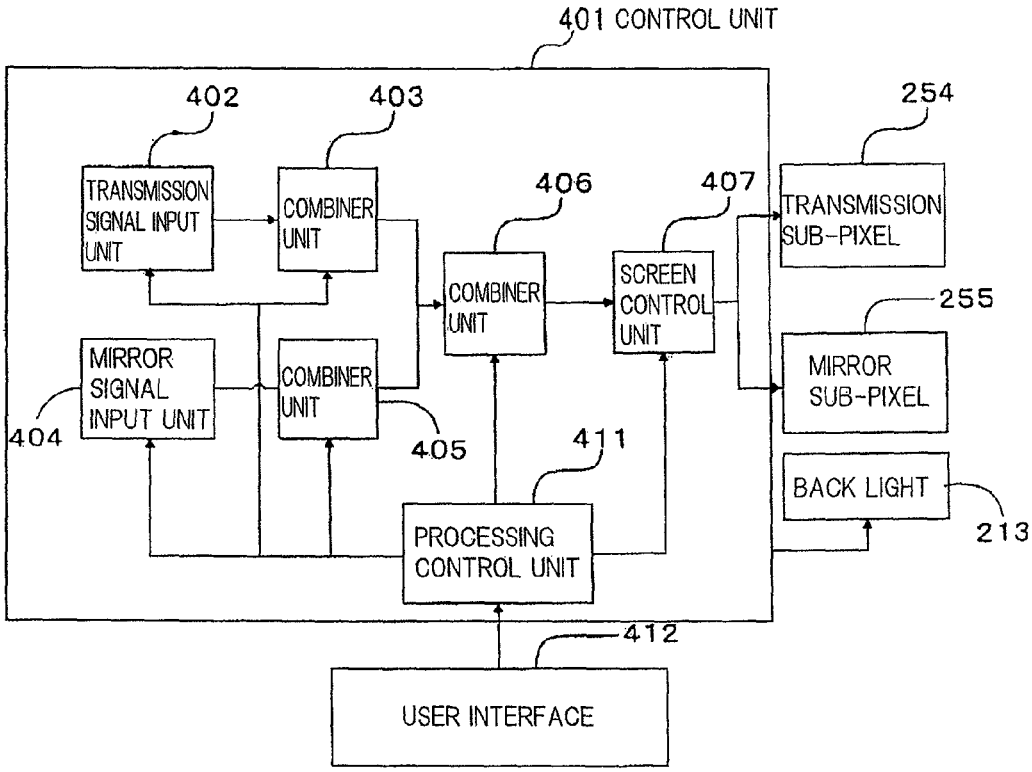
FIG. 9 is a block diagram showing a screen control function of the liquid crystal display device shown in FIG. 5.
Figure 10:
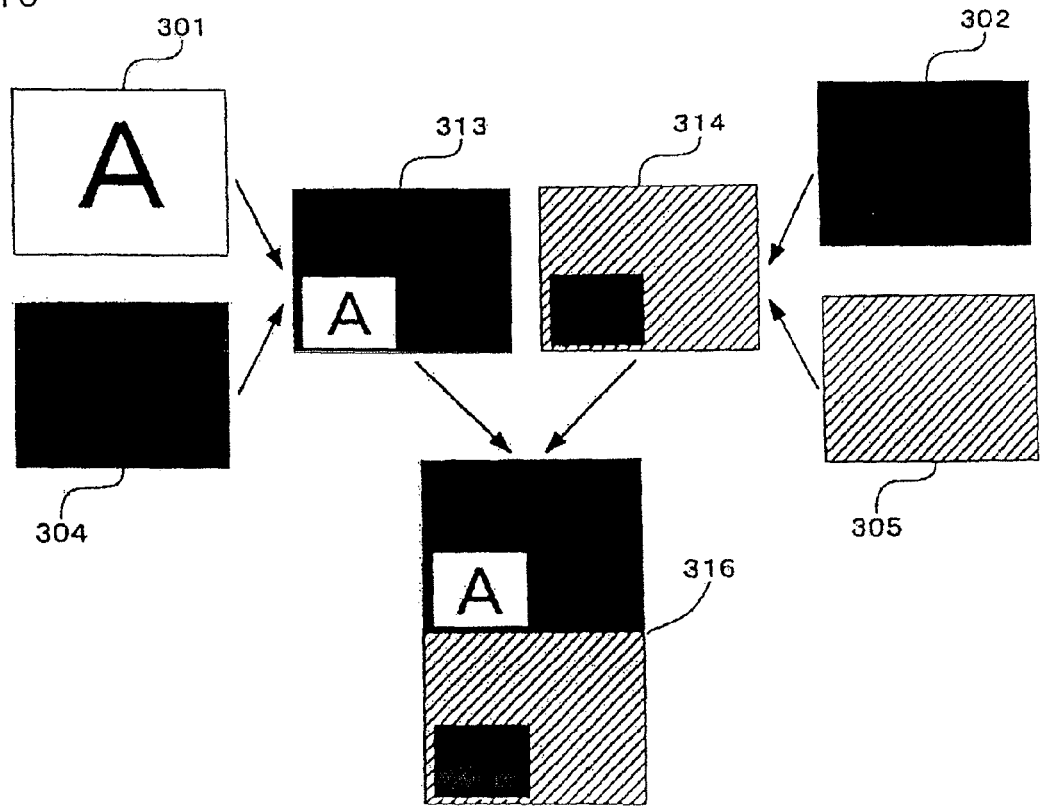
FIG. 10 is a diagram showing a screen control process in the liquid crystal display device shown in FIG. 5.

FIG. 9 is a block diagram showing a screen control function of the liquid crystal display device, and FIG. 10 shows an example of screen control process in accordance with the screen control function of FIG. 9. FIG. 10 shows a screen control process in the screen mode shown in FIG. 8E, as an example of the screen control.

This liquid crystal display device comprises control unit 401 for controlling transmission sub-pixels 254, mirror sub-pixels 255, and back light 213. Control unit 401 may be provided as a controller independent of the liquid crystal display device. Control unit 401 comprises processing control unit 411, transmission signal input unit 402, combiner unit 403, mirror signal input unit 404, combiner unit 405, combiner unit 406, and screen control unit 407. Processing control unit 411 controls the respective components based on signals applied thereto from user interface 412.

When a signal is applied to processing control unit 411 from user interface 412, processing control unit 411 first applies transmission signal input unit 402 with a transmission signal which includes image display information 301 for placing transmission sub-pixels 254 into an image display state and black display information 304 for placing transmission sub-pixels 254 into a black display state. Additionally, simultaneously with the foregoing, processing control unit 411 applies mirror signal input unit 404 with a mirror signal which includes non-mirror information 302 for placing mirror sub-pixels 255 into a non-mirror state and mirror information 305 for placing mirror sub-pixels 255 into a mirror state.

Upon receipt of the transmission signal, transmission signal input unit 402 sends image display information 301 and black display information 304 to combiner unit 403. Combiner unit 403 combines image display information 301 and black display information 304 based on a transmission position signal applied thereto from processing control unit 411 to form transmission sub-pixel information 313. Combiner 403 sends transmission sub-pixel information 313 to combiner 406.

Upon receipt of the mirror signal, mirror signal input unit 404 sends non-mirror information 302 and mirror information 305 to combiner unit 405. Combiner unit 405 combines non-mirror information 302 and mirror information 305 based on mirror position signal applied thereto from processing control unit 411 to form mirror sub-pixel information 314. Combiner unit 405 sends mirror sub-pixel information 314 to combiner 406.

Combiner 406 further combines transmission sub-pixel information 313 with mirror sub-pixel information 314 in such a manner that the base of transmission sub-pixel information 313 is bound to the upside of mirror sub-pixel information 314 to form screen control information 316. Then, combiner unit 406 sends screen control information 316 to screen control unit 407, so that screen control unit 407 drives transmission sub-pixels 254 and mirror sub-pixels 255 in accordance with screen control information 316.

Figure 11:
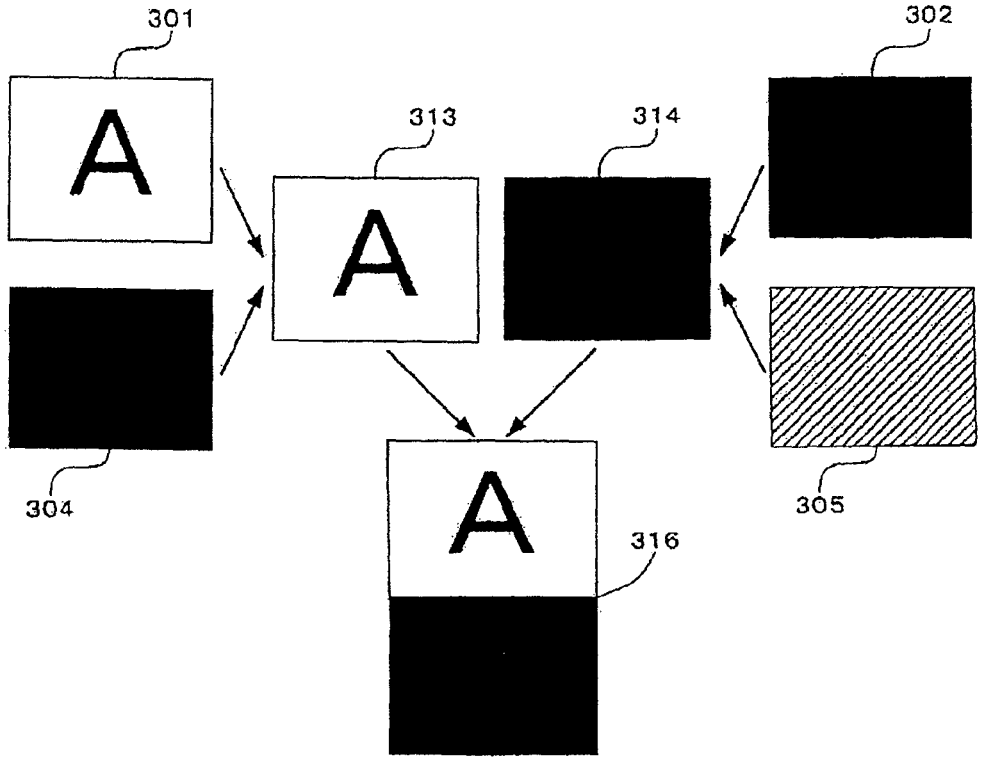
FIG. 11 is a diagram showing a screen control process in the liquid crystal display device shown in FIG. 5.
Figure 12:
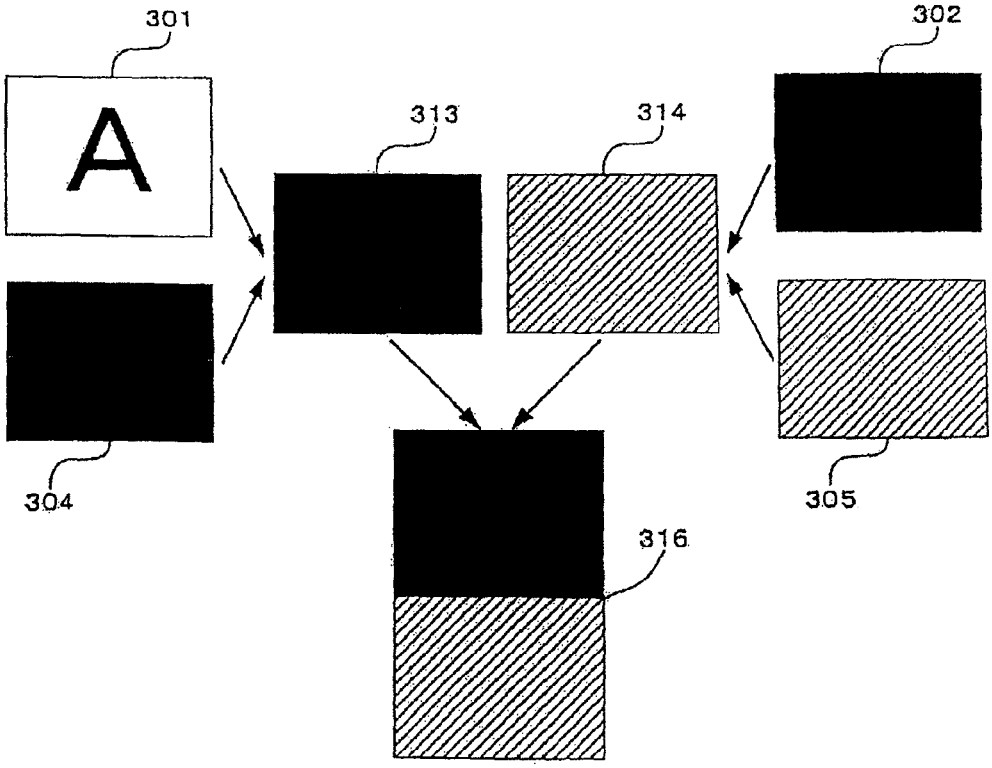
FIG. 12 is a diagram showing a screen control process in the liquid crystal display device shown in FIG. 5.

Control unit 401 can conduct screen control in other screen modes in a similar manner. For example, control unit 401 sets the entire screen shown in FIG. 8A to the display mode executing control as shown in FIG. 11, and sets the screen mode for setting the entire screen to the mirror mode, as shown in FIG. 8B, by conducing control as shown in FIG. 12.

A switching between the screen modes is performed by applying a mode switching signal to user interface 412 which serves as an input unit.

Figure 13A:
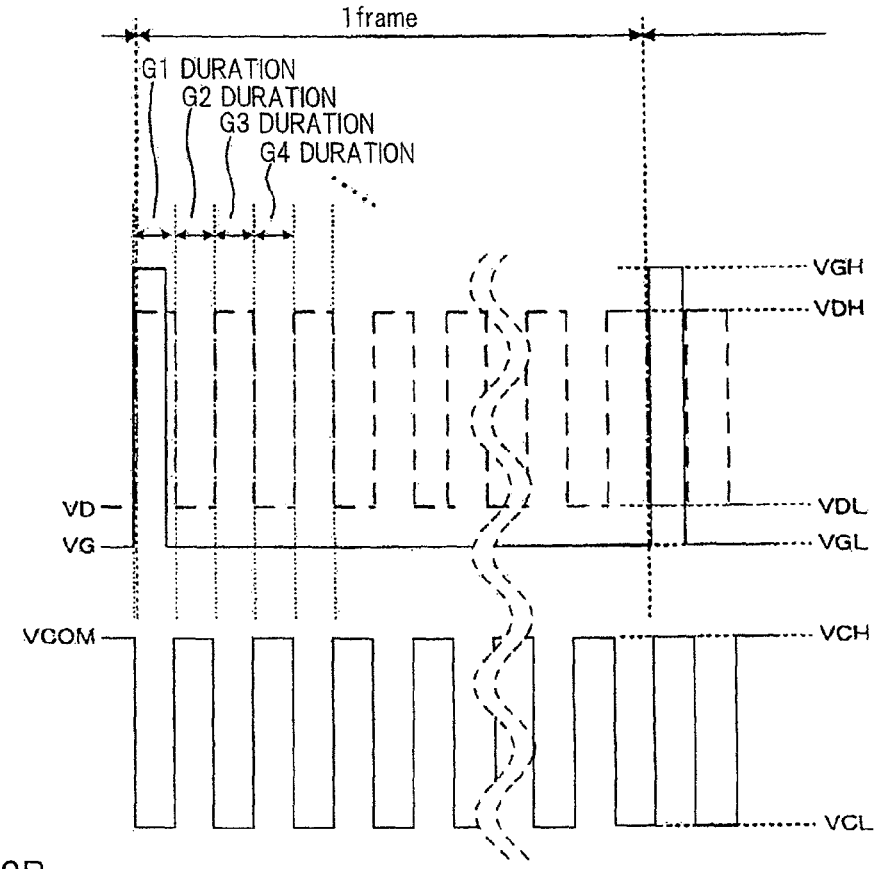
FIG. 13A is a diagram showing the waveforms of voltages applied to the liquid crystal display device shown in FIG. 5.
Figure 13B:
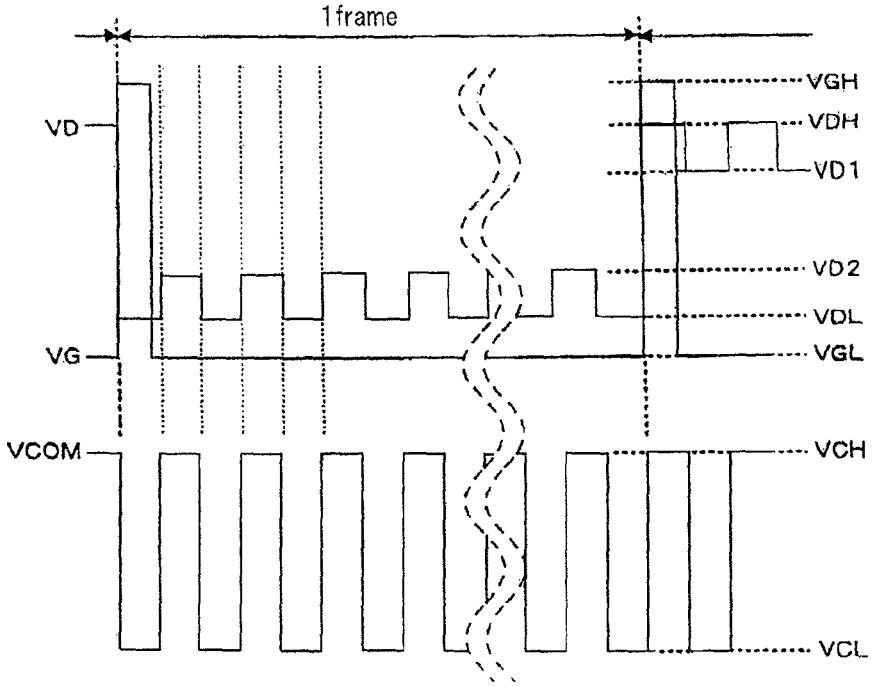
FIG. 13B is a diagram showing the waveforms of voltages applied to the liquid crystal display device shown in FIG. 5.

Referring next to FIGS. 13A and 13B, a description will be given of how to drive sub-pixels 254, 255 of the liquid crystal display device. While this liquid crystal display device employs a gate line inversion drive, the present invention can otherwise employ, for example, a source line inversion drive, a dot inversion drive, a frame inversion drive, and the like.

Here, a Gn duration designates a duration in which a voltage is applied to Gn among gate lines 253 shown in FIG. 5 to select a sub-pixel connected to Gn. Specifically, durations in which a voltage is applied to G1, G2, G3, G4 are designated by G1 duration, G2 duration, G3 duration, and G4 duration, respectively. While FIGS. 13A and 13B show the waveforms in G1 duration, they also applied to Gn duration other than G1 duration.

Referring first to FIG. 13A, a description will be given of the display mode of the liquid crystal display device. FIG. 13A shows the waveforms of voltages VG, VD, and VCOM which are applied to gate line 253, drain line 252, and common electrode 205, respectively, during G1 duration in the display mode.

The value of VG is set to VGH only during Gn duration for selecting a sub-pixel connected to each gate line 253 (Gn) and to VGL during the remaining durations. Specifically, the value of VG is VGH only during G1 duration, and VGL during the remaining durations. The value of VD can be determined within a range of VDL or higher to VDH or lower.

VCOM presents a common waveform both in the display mode and mirror mode. VCOM takes the values of VCH and VCL which is alternated each duration, and is also alternated each frame. Specifically, in the frame shown in FIG. 13A, VCOM has the value of VCL in G1 duration and VCH in G2 duration, and in the next frame. VCOM has the value of VCH in G1 duration and VCL in G2 duration.

It is assumed in this embodiment that VDH=VCH and VDL=VCL. More specifically, VDH=6V, VDL=1V, VCH=6V, and VCL=1V.

During G1 duration in the frame shown in FIG. 13A, a voltage having the value of (VD−VCL) is applied between transmission sub-pixel electrode 211 and common electrode 205 of transmission sub-pixel 254 connected to G1. Since the value of VD is equal to or higher than VCL in any transmission sub-pixel 254, a voltage having the value of 0 V or higher should be applied between transmission sub-pixel electrode 211 and common electrode 205. Notably, transmission sub-pixel 254 is placed into a voltage applied state when the value of VD is VDH.

Accordingly, transmission sub-pixel 254 connected to G1 at this time is in an image display state because a positive voltage can be applied between transmission sub-pixel electrode 211 and common electrode 205 by adjusting the value of VD.

Also, during Gn duration in the frame shown in FIG. 13A, since the value of VD is also equal to or higher than VCL in transmission sub-pixels 254 connected to gate lines 253 (Gn) other than G1, a voltage having the value of 0 V or higher should be applied between transmission sub-pixel electrode 211 and common electrode 205. Accordingly, any of transmission sub-pixels 254 connected to Gn at this time is in an image display state.

During G1 duration in the frame next to that shown in FIG. 13A, a voltage having the value of (VD−VCH) is applied between transmission sub-pixel electrode 211 and common electrode 205 of transmission sub-pixel 254 connected to G1. Since the value of VD is equal to or lower than VCH in any of transmission sub-pixels 254, a voltage having the value of 0 V or lower should be applied between transmission sub-pixel electrode 211 and common electrode 205. Notably, transmission sub-pixel 254 is placed into a voltage applied state when the value of VD is VDL.

Accordingly, transmission sub-pixel 254 connected to G1 at this time is in an image display state because a negative voltage can be applied between transmission sub-pixel electrode 211 and common electrode 205 by adjusting the value of VD.

Also, during Gn duration in the frame next to that shown in FIG. 13A, since the value of VD is also equal to or lower than VCH in transmission sub-pixels 254 connected to gate lines 253 (Gn) other than G1 during Gn duration, a voltage having the value of 0 V or lower should be applied between transmission sub-pixel electrode 211 and common electrode 205. Accordingly, any of transmission sub-pixels 254 connected to Gn at this time remains in an image display state.

As described above, this liquid crystal display device employs the gate line inversion drive. But when only transmission sub-pixel 254 in the display mode is focused on, the liquid crystal display device is driven in a manner similar to a frame inversion driving method because the polarity of the voltage applied between transmission sub-pixel electrode 211 and common electrode 205 is inverted for every frame but is not inverted for every gate line 253.

Also, during Gn duration in the display mode of this liquid crystal display device, the value of VD is set equal to the value of VCOM in any of mirror sub-pixels 255 connected to Gn. In this way, a voltage having the value of 0 V is applied between mirror sub-pixel electrode 212 and common electrode 205 in any mirror sub-pixel 255, so that mirror sub-pixel 255 is placed into a non-voltage applied state and accordingly is placed in a non-mirror state.

This liquid crystal display device can place transmission sub-pixels 254 into an image display state and place mirror sub-pixels 255 into a non-mirror state by driving sub-pixels 254, 255 in the foregoing manner. In this way, this liquid crystal display device can realize the display mode.

Referring next to FIG. 13B, a description will be given of the mirror mode of the liquid crystal display device. FIG. 13B shows the waveforms of voltages VG, VD, and VCOM applied to gate line 253, drain line 252, and common electrode 205, respectively, during G1 duration in the mirror mode.

The value of VG is set to VGH only during Gn duration for selecting a sub-pixel connected to each gate line 253 (Gn) and to VGL during the remaining durations. Specifically, the value of VG at G1 is VGH only during G1 duration, and VGL during the remaining durations.

VD takes the values of VDH and VDL which are alternated every frame. Specifically, the value of VD is VDL in a frame shown in FIG. 13B, and the value of VD is VDH in the next frame. Notably, in this embodiment, since a phase difference of $\lambda/4$ must be given to light which is transmitted liquid crystal layer 206 in mirror sub-pixel 255 in a voltage applied state, the value of VD is set to VD1 lower than VDH or to VD2 higher than VDL during a period (G2 duration, G4 duration, . . . ) for selecting gate electrode 253 connected to mirror sub-pixel 255. In this embodiment, VD1=4V, and VD2=3V.

During G1 duration in the frame shown in FIG. 13B, a voltage having the value of (VD−VCL) is applied between transmission sub-pixel electrode 211 and common electrode 205 of transmission sub-pixel 254 connected to G1. Since the value of VD is VDL in any of transmission sub-pixels 254, a voltage having the value of 0 V is applied between transmission sub-pixel electrode 211 and common electrode 205. Accordingly, since any one of transmission sub-pixels 254 connected to G1 at this time is placed into a non-voltage applied state, this one sub-pixel presents a black display state.

Also, during Gn duration in the frame shown in FIG. 13B, since the value of VD is also equal to VDL in transmission sub-pixels 254 connected to gate lines 253 (Gn) other than G1 during Gn duration, a voltage having the value of 0 V or lower should be applied between transmission sub-pixel electrode 211 and common electrode 205. Accordingly, since any one of transmission sub-pixels 254 connected to Gn at this time is placed into a non-voltage applied state, this one sub-pixel presents a black display state.

During G1 duration in the frame next to that shown in FIG. 13B, a voltage having the value of (VD−VCH) is applied between transmission sub-pixel electrode 211 and common electrode 205 of transmission sub-pixel 254 connected to G1. Since the value of VD is equal to VDH in any of transmission sub-pixels 254, a voltage having the value of 0 V should be applied between transmission sub-pixel electrode 211 and common electrode 205. Accordingly, since any one of transmission sub-pixels 254 connected to G1 at this time is placed into a non-voltage applied state, this one sub-pixel presents a black display state.

Also, during Gn duration in the frame next to that shown in FIG. 13B, since the value of VD is also equal to VDH in transmission sub-pixels 254 connected to gate lines 253 (Gn) other than G1 during Gn duration, a voltage having the value of 0 V should be applied between transmission sub-pixel electrode 211 and common electrode 205. Accordingly, since any one of transmission sub-pixels 254 connected to Gn at this time is placed into a non-voltage applied state, this one sub-pixel presents a black display state.

During G2 duration in the frame shown in FIG. 13B, a voltage having the value of (VD−VCH) is applied between mirror sub-pixel electrode 212 and common electrode 205 of mirror sub-pixel 255 connected to G2. Since the value of VD is equal to VD2 in any of mirror sub-pixels 255, a voltage having the value of (VD2−VCH) is applied between mirror sub-pixel electrode 212 and common electrode 205. In this event, since any one of mirror sub-pixels 255 is placed into a voltage applied state, this one sub-pixel presents a mirror state.

Also, during Gn duration in the frame shown in FIG. 13B, the value of VD is also equal to VD2 in mirror sub-pixels 255 connected to gate lines 253 (Gn) other than G2 during Gn duration. Since any one of mirror sub-pixels 255 is placed into a voltage applied state, this one sub-pixel presents a mirror state.

During G2 duration in the frame next to that shown in FIG. 13B, a voltage having the value of (VD−VCL) is applied between mirror sub-pixel electrode 212 and common electrode 205 of mirror sub-pixel 255 connected to G2. Since the value of VD is equal to VD1 in any of mirror sub-pixels 255, a voltage having the value of (VD1−VCL) is applied between mirror sub-pixel electrode 212 and common electrode 205. In this event, since any one of mirror sub-pixels 255 is placed into a voltage applied state, this one sub-pixel presents a mirror state.

Also, during G2 duration in the frame next to that shown in FIG. 13B, the value of VD is also equal to VD1 during Gn duration in mirror sub-pixels 255 connected to gate lines 253 (Gn) other than G2. Since any one of mirror sub-pixels 255 is placed into a voltage applied state, this one sub-pixel presents a mirror state.

As described above, this liquid crystal display device employs the gate line inversion driving method. But when only on mirror sub-pixel 255 in the mirror mode is focused on, the liquid crystal display device is driven in a manner similar to a frame inversion driving method because the polarity of the voltage applied between mirror sub-pixel electrode 212 and common electrode 205 is inverted for every frame but is not inverted for every gate line 253.

This liquid crystal display device can place transmission sub-pixels 254 into a black display state as well as place mirror sub-pixels 255 into a mirror state by driving sub-pixels 254, 255 in the foregoing manner. In this way, this liquid crystal display device can realize the mirror mode.

Figure 14:
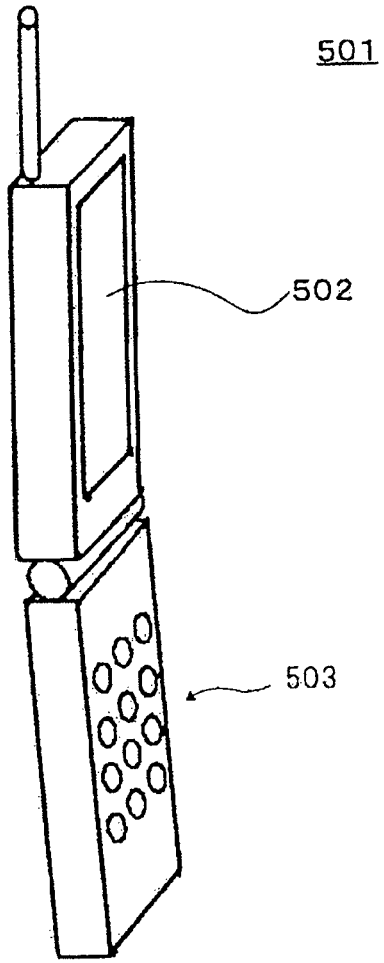
FIG. 14 is a perspective view of an electronic device to which the liquid crystal display device shown in FIG. 5 can be applied.

FIG. 14 is a perspective view of an electronic device to which the liquid crystal display device according to this embodiment can be applied. While FIG. 14 shows a portable telephone as one example of electronic device 501, the liquid crystal display device according to this embodiment can also be applied to a variety of portable terminal devices except for the portable telephone, such as portable information terminals (PDA: Personal Digital Assistants), game machines, digital cameras, digital video cameras and so on. Further, the liquid crystal display device according to this embodiment can be applied to a variety of terminal devices such as notebook type personal computers, cash dispensers, automatic vending machines, and the like, except for portable terminal devices.

Electronic device 501 comprises liquid crystal display device 502 according to this embodiment, and operation unit 503 which is a user interface manipulated by the user.

The user can switch liquid crystal display device 502 from the display mode to the mirror mode, and vice versa by manipulating operation unit 503. The user can manipulate operation unit 503 while viewing an image displayed on liquid crystal display device 502 in the display mode, and can use liquid crystal display device 502 as a mirror in the mirror mode.

(Second Embodiment)

Figure 15A:
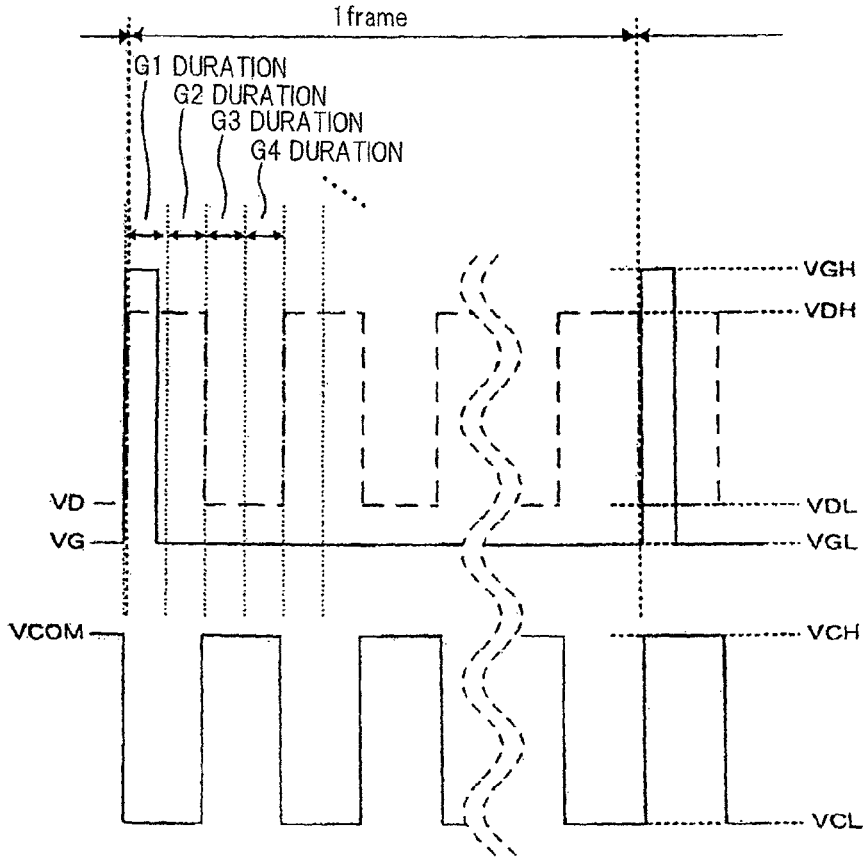
FIG. 15A is a diagram showing the waveforms of voltages applied to a liquid crystal display device according to a second embodiment of the present invention.
Figure 15B:
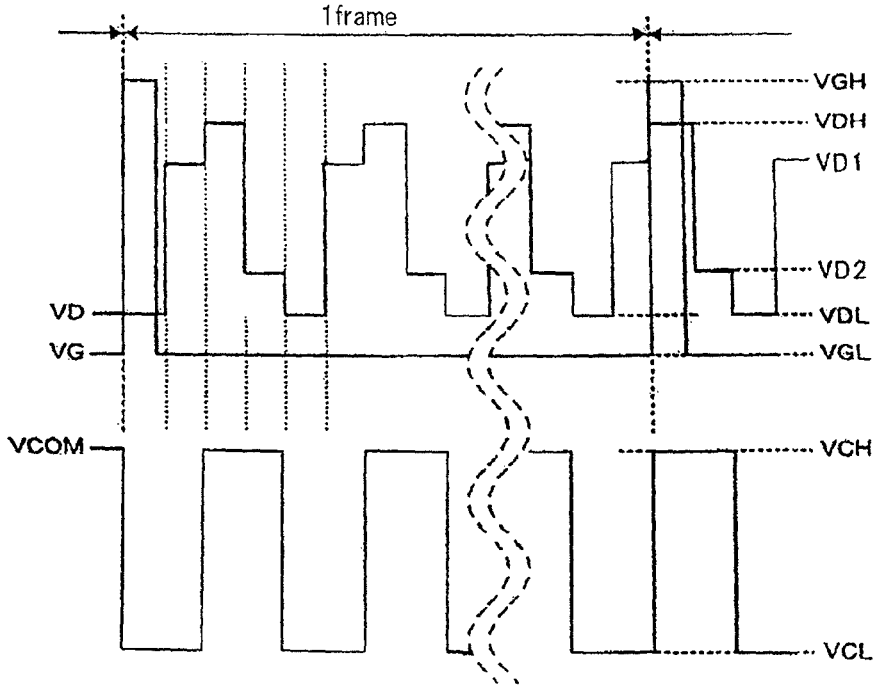
FIG. 15B is a diagram showing the waveforms of voltages applied to a liquid crystal display device according to a second embodiment of the present invention.

Referring next to FIGS. 15A and 15B, a description will be given of a liquid crystal display device according to a second embodiment of the present invention. The liquid crystal display device according to this embodiment is configured in a manner similar to the liquid crystal display device according to the first embodiment except for the waveforms of the voltages which are applied for driving the liquid crystal display device. Therefore, the following description will be given with reference to the drawings which were used for describing the configuration of the liquid crystal display device according to the first embodiment.

Referring first to FIG. 15A, a description will be given of the display mode of this liquid crystal display device. FIG. 15A shows the waveforms of voltages VG, VD, and VCOM which are applied to gate line 253, drain line 252, and common electrode 205, respectively, during G1 duration in the display mode.

The value of VG is set to VGH only during Gn duration for selecting a sub-pixel connected to each gate line 253 (Gn) and to VGL during the remaining durations. Specifically, the value of VG at G1 is VGH only during G1 duration, and VGL during the remaining durations. The value of VD can be determined within a range of VDL or higher to VDH or lower.

VCOM presents a common waveform both in the display mode and mirror mode. VCOM takes the values of VCH and VCL which are alternated every two durations, and are also alternated every frame. Specifically, in the frame shown in FIG. 15A, VCOM has the value of VCL in G1 duration and G2 duration and VCH in G3 duration and G4 duration, and in the next frame, VCOM has the value of VCH in G1 duration and G2 duration, and VCL in G3 duration and G4 duration.

It is assumed in this embodiment that VDH=VCH and VDL=VCL. More specifically, VDH=6V, VDL=1V, VCH=6V, and VCL=1V.

During G1 duration in the frame shown in FIG. 15A, a voltage having the value of (VD−VCL) is applied between transmission sub-pixel electrode 211 and common electrode 205 of transmission sub-pixel 254 connected to G1. Since the value of VD is equal to or higher than VCL in any transmission sub-pixel 254, a voltage having the value of 0 V or higher should be applied between transmission sub-pixel electrode 211 and common electrode 205.

Accordingly, transmission sub-pixel 254 connected to G1 at this time is in an image display state, where a positive voltage can be applied between transmission sub-pixel electrode 211 and common electrode 205 by adjusting the value of VD.

Also, during G3 duration in the frame shown in FIG. 15A, a voltage having the value of (VD−VCH) is applied between transmission sub-pixel electrode 211 and common electrode 205 of transmission sub-pixel 254 connected to G3. Since the value of VD is equal to or lower than VCH in any transmission sub-pixel 254, a voltage having the value of 0 V or lower should be applied between transmission sub-pixel electrode 211 and common electrode 205.

Accordingly, transmission sub-pixel 254 connected to G1 at this time is in an image display state, where a negative voltage can be applied between transmission sub-pixel electrode 211 and common electrode 205 by adjusting the value of VD.

Also, during Gn duration in the frame shown in FIG. 15A, the voltage applied between transmission sub-pixel electrode 211 and common electrode 205 of transmission sub-pixel 254 connected to gate line 253 (Gn) alternates between 0 V or higher and 0 V or lower subsequent to G1 and G3 durations as well. Accordingly, any of transmission sub-pixels 254 connected to Gn at this time is in an image display state.

During G1 duration in the frame next to that shown in FIG. 15A, a voltage having the value of (VD−VCH) is applied between transmission sub-pixel electrode 211 and common electrode 205 of transmission sub-pixel 254 connected to G1. Since the value of VD is equal to or lower than VCH in any of transmission sub-pixels 254, a voltage having the value of 0 V or lower should be applied between transmission sub-pixel electrode 211 and common electrode 205.

Accordingly, transmission sub-pixel 254 connected to G1 at this time is in an image display state, where a negative voltage can be applied between transmission sub-pixel electrode 211 and common electrode 205 by adjusting the value of VD.

Also, during G3 duration in the frame next to that shown in FIG. 15A, a voltage having the value of (VD−VCL) is applied between transmission sub-pixel electrode 211 and common electrode 205 of transmission sub-pixel 254 connected to G3. Since the value of VD is equal to or higher than VCL in any transmission sub-pixel 254, a voltage having the value of 0 V or higher should be applied between transmission sub-pixel electrode 211 and common electrode 205.

Accordingly, transmission sub-pixel 254 connected to G1 at this time is in an image display state, where a positive voltage can be applied between transmission sub-pixel electrode 211 and common electrode 205 by adjusting the value of VD.

Also, during Gn duration in the frame next to that shown in FIG. 15A, the voltage applied between transmission sub-pixel electrode 211 and common electrode 205 of transmission sub-pixel 254 connected to gate line 253 (Gn) alternates between 0 V or lower and 0 V or higher subsequent to G1 and G3 durations as well. Accordingly, any of transmission sub-pixels 254 connected to Gn at this time is in an image display state.

As described above, this liquid crystal display device employs the gate line inversion driving method, like the liquid crystal display device according to the first embodiment, but differs from the liquid crystal display device according to the first embodiment by simply focusing attention only on transmission sub-pixel 254 in the display mode, in that the polarity of the voltage applied between transmission sub-pixel electrode 211 and common electrode 205 is inverted for every gate line 253, and is also inverted every frame. Since the polarity of the voltage applied between transmission sub-pixel electrode 211 and common electrode 205 is inverted for every gate line 253 in the display mode, flickers are less prominent even when the frame period is short.

During Gn duration in the display mode of this liquid crystal display device, the value of VD is made equal to the value of VCOM in any of mirror sub-pixels 255 connected to Gn. In this way, a voltage having the value of 0 V is applied between mirror sub-pixel electrode 212 and common electrode 205 in any of mirror sub-pixels 255, so that mirror sub-pixel 255 is placed into a non-voltage applied state and therefore a non-mirror state.

This liquid crystal display device can place transmission sub-pixels 254 into an image display state and mirror sub-pixels 255 into a non-mirror state by driving sub-pixels 254, 255 in the foregoing manner. In this way, this liquid crystal display device can realize the display mode.

Referring next to FIG. 15B, a description will be given of the mirror mode of this liquid crystal display device. FIG. 15B shows the waveforms of voltages VG, VD, and VCOM applied to gate line 253, drain line 252, and common electrode 205, respectively, during G1 duration in the mirror mode.

The value of VG is set to VGH only during Gn duration for selecting a sub-pixel connected to each gate line 253 (Gn) and to VGL during the remaining durations. Specifically, the value of VG at G1 is VGH only during G1 duration, and VGL during the remaining durations.

VD takes the values of VDH and VDL which are alternated every two durations and also are alternated every frame. Further, VD presents a waveform which is shifted by one duration from the waveform of VCOM. Specifically, the value of VD is VDL during G1 duration, and VDH during G2 duration and G3 duration in the frame shown in FIG. 15B, and the value of VD is VCH during G1 duration, and VCL during G2 duration and G3 duration in the next frame.

Notably, in this embodiment, since a phase difference of λ/4 must be given to light which is transmitted liquid crystal layer 206 in mirror sub-pixel 255 in a voltage applied state, the value of VD is set to VD1 lower than VDH or to VD2 higher than VDL during a period (G2 duration, G4 duration, . . . ) for selecting gate electrode 253 connected to mirror sub-pixel 255. In this embodiment, VD1=4V, and VD2=3V.

During G1 duration in the frame shown in FIG. 15B, a voltage having the value of (VD−VCL) is applied between transmission sub-pixel electrode 211 and common electrode 205 of transmission sub-pixel 254 connected to G1. Since the value of VD is VDL in any transmission sub-pixel 254, a voltage having the value of 0 V is applied between transmission sub-pixel electrode 211 and common electrode 205. Accordingly, since any one of transmission sub-pixels 254 connected to G1 at this time is placed into a non-voltage applied state, this one sub-pixel presents a black display state.

Also, during G3 duration in the frame shown in FIG. 15B, a voltage having the value of (VD−VCH) is applied between transmission sub-pixel electrode 211 and common electrode 205 of transmission sub-pixel 254 connected to G3. Since the value of VD is equal to VDH in any transmission sub-pixel 254, a voltage having the value of 0 V should be applied between transmission sub-pixel electrode 211 and common electrode 205. Accordingly, transmission sub-pixel 254 connected to G3 at this time presents a black display state because any of transmission sub-pixels 254 connected to G3 at this time is placed into a non-voltage applied state.

Also, during Gn duration in the frame shown in FIG. 15B, since the value of VD is also equal to the value of VCOM during Gn duration in transmission sub-pixels 254 connected to gate lines 253 (Gn) except for G1 and G3, a voltage having the value of 0 V should be applied between transmission sub-pixel electrode 211 and common electrode 205. Accordingly, since any one of transmission sub-pixels 254 connected to Gn at this time is placed into a non-voltage applied state, this one sub-pixel presents a black display state.

During G1 duration in the frame next to that shown in FIG. 15B, a voltage having the value of (VD−VCH) is applied between transmission sub-pixel electrode 211 and common electrode 205 of transmission sub-pixel 254 connected to G1. Since the value of VD is equal to VDH in any of transmission sub-pixels 254, a voltage having the value of 0 V should be applied between transmission sub-pixel electrode 211 and common electrode 205. Accordingly, since any one of transmission sub-pixels 254 connected to G1 at this time is placed into a non-voltage applied state, this one sub-pixel presents a black display state.

Also, during G3 duration in the frame next to that shown in FIG. 15B, a voltage having the value of (VD−VCL) is applied between transmission sub-pixel electrode 211 and common electrode 205 of transmission sub-pixel 254 connected to G3. Since the value of VD is equal to VDL in any transmission sub-pixel 254, a voltage having the value of 0 V should be applied between transmission sub-pixel electrode 211 and common electrode 205. Accordingly, since any of transmission sub-pixels 254 connected to G3 at this time is placed into a non-voltage applied state, it presents a black display state.

Also, during Gn duration in the frame next to that shown in FIG. 15B, since the value of VD at Gn is also equal to the value of VCOM in transmission sub-pixels 254 connected to gate lines 253 (Gn) other than G1 and G3, a voltage having the value of 0 V should be applied between transmission sub-pixel electrode 211 and common electrode 205. Accordingly, since any one of transmission sub-pixels 254 connected to Gn at this time is placed into a non-voltage applied state, this one sub-pixel presents a black display state.

During G2 duration in the frame shown in FIG. 15B, a voltage having the value of (VD−VCL) is applied between mirror sub-pixel electrode 212 and common electrode 205 of mirror sub-pixel 255 connected to G2. Since the value of VD is equal to VD1 in any of mirror sub-pixels 255, a voltage having the value of (VD1−VCL) is applied between mirror sub-pixel electrode 212 and common electrode 205. In this event, since any one of mirror sub-pixels 255 is placed into a voltage applied state, this one sub-pixel presents a mirror state.

Also, during G4 duration in the frame shown in FIG. 15B, a voltage having the value of (VD−VCH) is applied between mirror sub-pixel electrode 212 and common electrode 205 of mirror sub-pixel 255 connected to G4. Since the value of VD is equal to VD2 in any of mirror sub-pixels 255, a voltage having the value of (VD2−VCH) is applied between mirror sub-pixel electrode 212 and common electrode 205. In this event, since any one of mirror sub-pixels 255 is placed into a voltage applied state, this one sub-pixel presents a mirror state.

Also, during Gn duration in the frame shown in FIG. 15B, the voltage applied between transmission sub-pixel electrode 211 and common electrode 205 of transmission sub-pixel 254 connected to gate line 253 (Gn) alternates between 0 V or higher and 0 V or lower subsequent to G1 and G3 durations as well. Accordingly, any one of transmission sub-pixels 254 connected to Gn at this time is in an image display state.

During G2 duration in the frame next to that shown in FIG. 15B, a voltage having the value of (VD−VCH) is applied between mirror sub-pixel electrode 212 and common electrode 205 of mirror sub-pixel 255 connected to G2. Since the value of VD is equal to VD2 in any of mirror sub-pixels 255, a voltage having the value of (VD2−VCH) is applied between mirror sub-pixel electrode 212 and common electrode 205. In this event, since any one of mirror sub-pixels 255 is placed into a voltage applied state, this one sub-pixel presents a mirror state.

Also, during G4 duration in the frame next to that shown in FIG. 15B, a voltage having the value of (VD−VCL) is applied between mirror sub-pixel electrode 212 and common electrode 205 of mirror sub-pixel 255 connected to G4. Since the value of VD is equal to VD1 in any of mirror sub-pixels 255, a voltage having the value of (VD1−VCL) is applied between mirror sub-pixel electrode 212 and common electrode 205. In this event, since any one of mirror sub-pixels 255 is placed into a voltage applied state, this one sub-pixel presents a mirror state.

Also, during Gn duration in the frame next to that shown in FIG. 15B, a negative voltage and a positive voltage are alternately applied between transmission sub-pixel electrode 211 and common electrode 205 of transmission sub-pixel 254 connected to gate line 253 (Gn) subsequent to G2 and G4 durations as well. Accordingly, any one of mirror sub-pixels 255 connected to Gn at this time is in a mirror state.

As described above, this liquid crystal display device employs the gate line inversion driving method, like the liquid crystal display device according to the first embodiment, but differs from the liquid crystal display device according to the first embodiment in that the polarity of the voltage applied between mirror sub-pixel electrode 212 and common electrode 205 is inverted every gate line 253, and is also inverted every frame, as can be recognized by simply focusing attention only on mirror sub-pixel 255 in the mirror mode.

This liquid crystal display device can place transmission sub-pixels 254 into a black display state as well as place mirror sub-pixels 255 into a mirror state by driving sub-pixels 254, 255 in the foregoing manner. In this way, this liquid crystal display device can realize the mirror mode.

(Third Embodiment)

Figure 16:
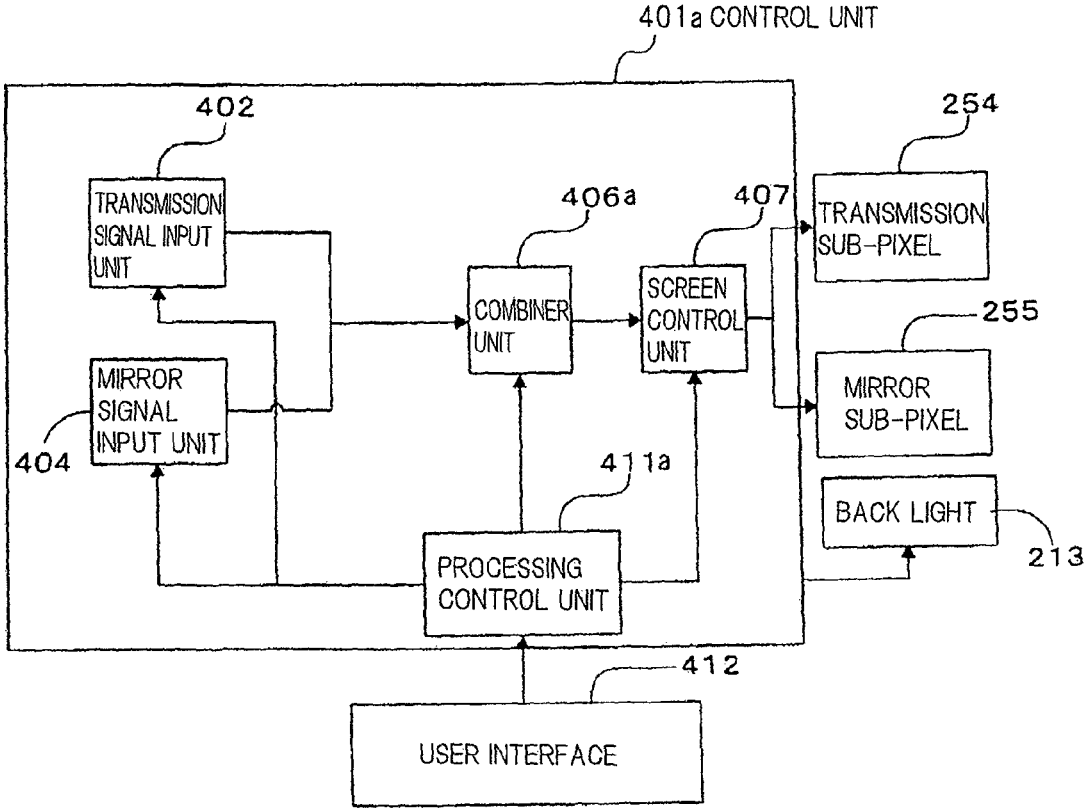
FIG. 16 is a block diagram showing a screen control function of a liquid crystal display device according to a third embodiment of the present invention.
Figure 17:
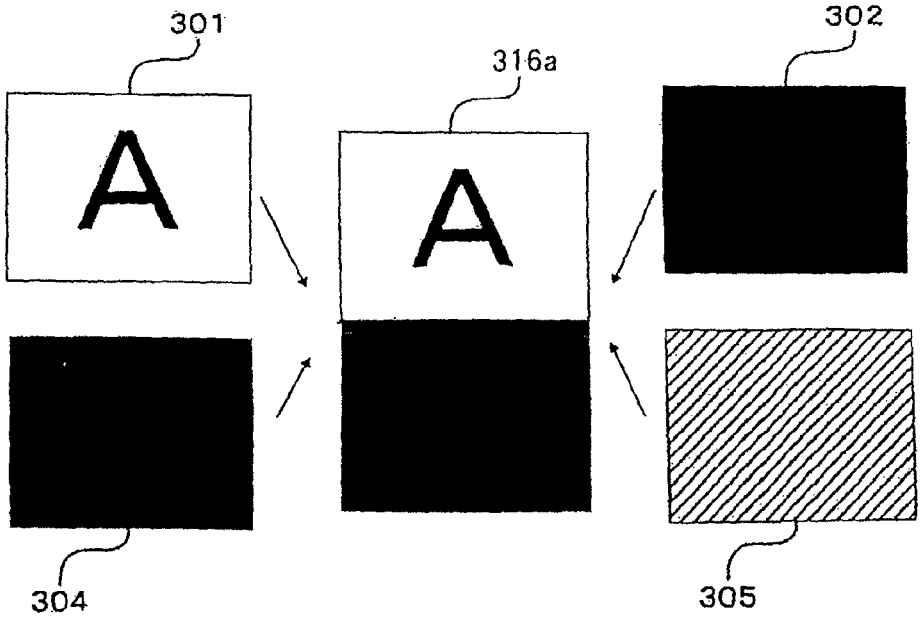
FIG. 17 is a diagram showing a screen control process in the liquid crystal display device according to the third embodiment of the present invention.

Referring next to FIGS. 16 and 17, a description will be given of a liquid crystal display device according to a third embodiment of the present invention. The liquid crystal display device according to this embodiment is constructed in a manner similar to the liquid crystal display device according to the first embodiment except for the control unit. FIGS. 16 and 17 correspond to FIGS. 9 and 10 in the first embodiment, where the same components are designated by the same reference numerals.

FIG. 16 is a block diagram showing a screen control function of the liquid crystal display device, and FIG. 17 is a diagram showing an example of screen control process in accordance with the screen control function. FIG. 17 shows a screen control process in the screen mode shown in FIG. 8A as an example of the screen control.

This liquid crystal display device does not comprise combiner units 403, 405 shown in FIG. 9.

Specifically, combiner unit 406*a* combines image display information 301 and black display information 304 applied thereto from display signal input unit 402 and non-mirror information 302 and mirror information 305 applied thereto from mirror signal input unit 404 into screen control information 316*a* based on a transmission position signal and a mirror position signal applied thereto from processing control unit 411*a*.

Then, combiner unit 406*a* sends screen control information 316*a* to screen control unit 407, such that screen control unit 407 drives transmission sub-pixels 254 and mirror sub-pixel 255 in accordance with screen control information 316*a*.

In this embodiment, for example, transmission sub-pixel information 313 (see FIG. 10) which represents a mixture of an image display state and a black display state cannot be created from image display information 301 and black display information 304. However, a screen mode for mixing the display mode with the mirror mode can also be implemented in this embodiment by applying transmission signal input unit 402 with previously combined transmission sub-pixel information 313 from processing control unit 411, and recording previously combined transmission sub-pixel information 314 in a memory of mirror signal input unit 404. Consequently, control unit 401*a* can conduct the image control in the other screen modes as shown, for example, in FIGS. 8B-8E in a similar manner.

(Fourth Embodiment)

Figure 18:
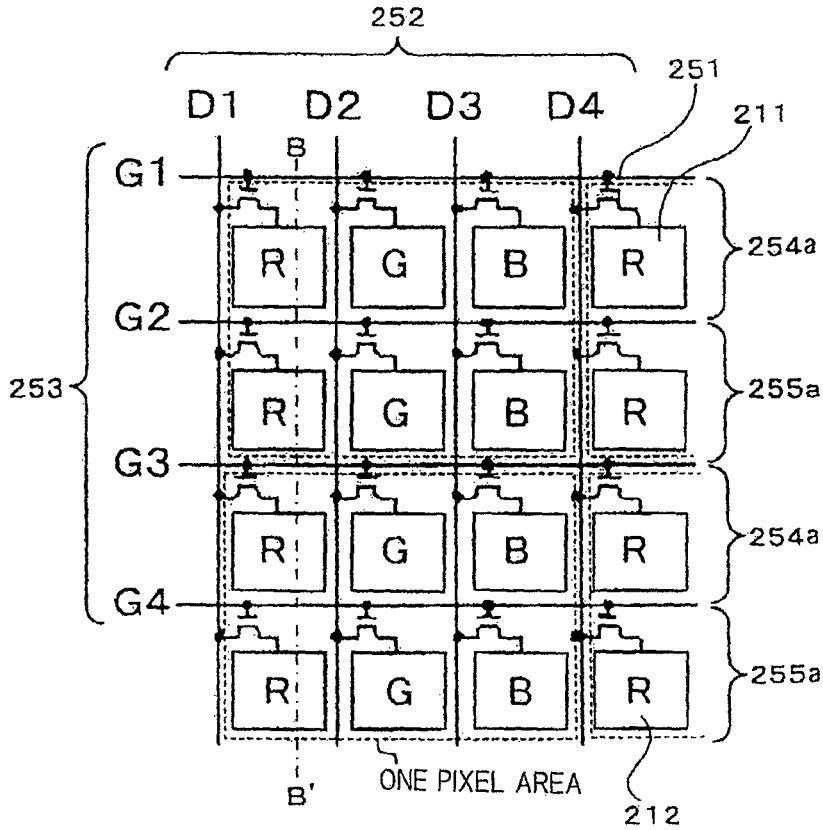
FIG. 18 is a schematic diagram showing the configuration of circuits in a liquid crystal display device according to a fourth embodiment of the present invention.
Figure 19:
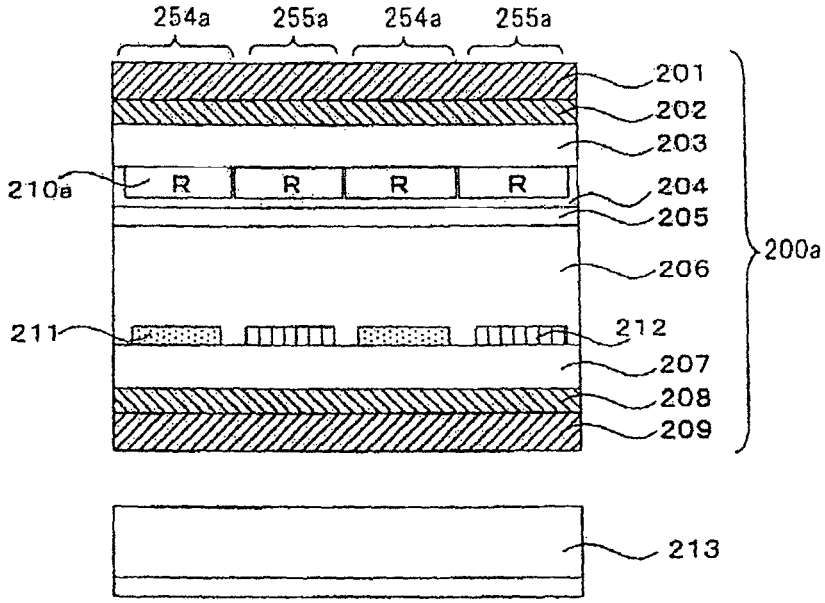
FIG. 19 is a cross-sectional view of the liquid crystal display device shown in FIG. 18, taken along line B-B'.
Figure 20:
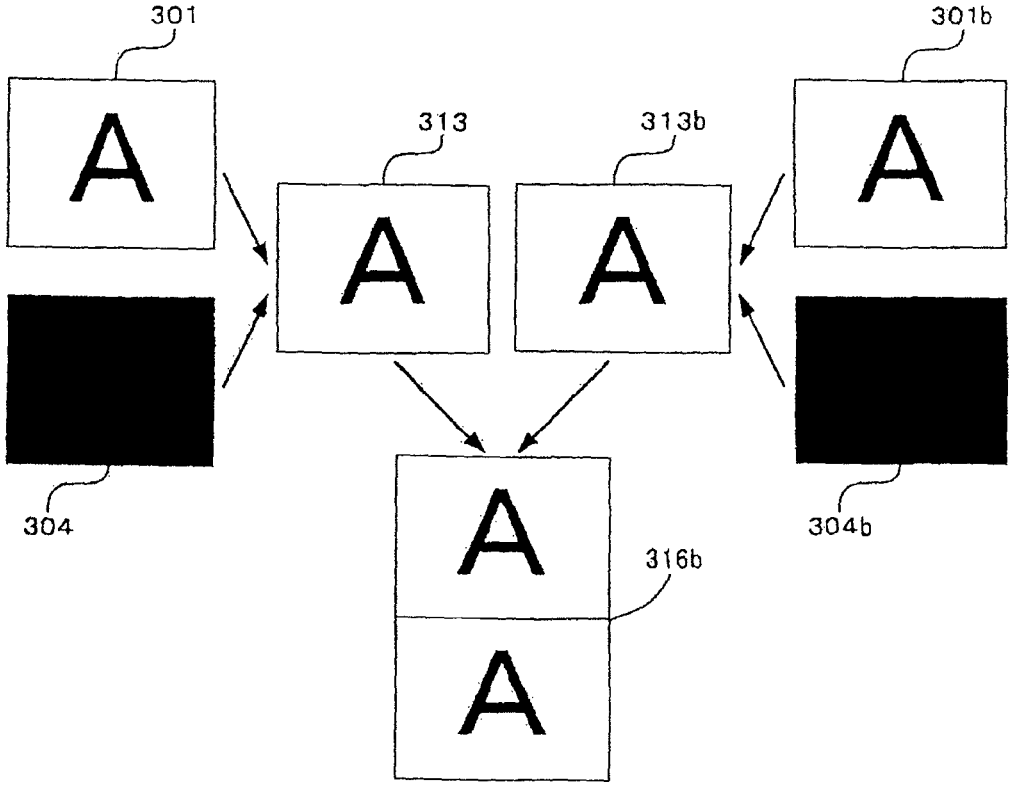
FIG. 20 is a diagram showing a screen control process in the liquid crystal display device shown in FIG. 18.

Referring next to FIGS. 18 through 20, a description will be given of a liquid crystal display device according to a fourth embodiment of the present invention. The liquid crystal display device according to this embodiment is constructed in a manner similar to the liquid crystal display device according to the first embodiment except for components discussed below. FIGS. 18 and 19 correspond to FIGS. 5 and 6 in the first embodiment, where the same components are designated by the same reference numerals.

FIG. 18 is a schematic diagram showing the configuration of circuits in the liquid crystal display device according to this embodiment, and FIG. 19 is a cross-sectional view of the liquid crystal display device shown in FIG. 18, taken along line B-B'.

Unlike the liquid crystal display device according to the first embodiment, this liquid crystal display device also comprises coloring layer 201*a* in mirror sub-pixel 255*a*. Also, in this liquid crystal display device, mirror sub-pixels 255*a* are placed into a mirror state even in the display mode. In this event, processing control unit 411 shown in FIG. 9 applies mirror signal input unit 404 with image display information 301*b* and black display information 304*b*, shown in FIG. 20, to combine screen control information 316*b*. In this way, the liquid crystal display device can display a color image not only with light which is transmitted through transmission sub-pixels 254*a* but also with light reflected by mirror sub-pixels 255*a*.

Accordingly, in this liquid crystal display device, one pixel is made up of three transmission sub-pixels and three mirror sub-pixels indicated by a broken line which surrounds them in FIG. 18. Specifically, one pixel includes transmission sub-pixels 254*a* and mirror sub-pixels 255*a*, each for displaying one of red, blue, and green.

Also, in the mirror mode of this liquid crystal display device, all transmission sub-pixels 254*a* are placed into a non-voltage applied state, and all mirror sub-pixels 255*a* are placed into a voltage applied state, as is the case with the liquid crystal display device according to the first embodiment. In this way, in the mirror mode of this liquid crystal display device, the colors of reflected light from mirror sub-pixels 255*a* for displaying red, blue, and green are mixed with each other to emit colorless reflected light toward the front surface of liquid crystal panel 200*a*.

(Fifth Embodiment)

Figure 21:
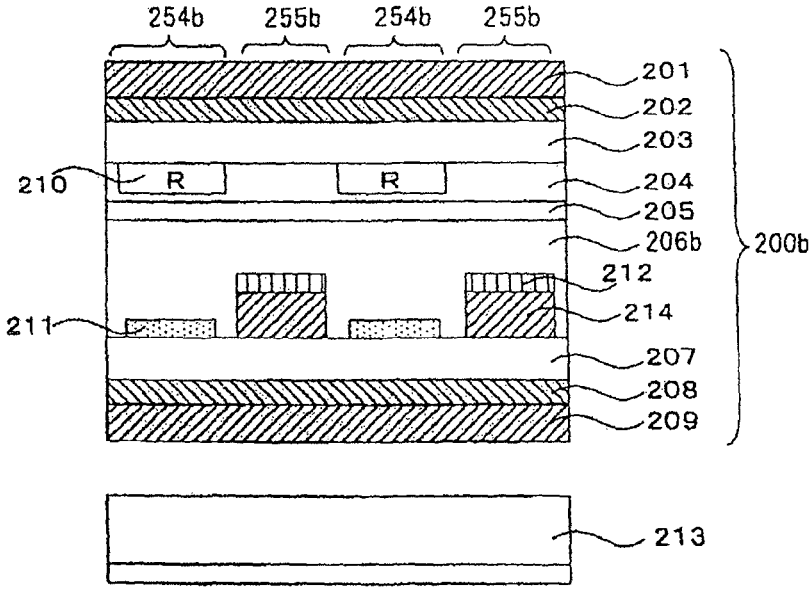
FIG. 21 is a cross-sectional view of a liquid crystal display device according to a fifth embodiment of the present invention.
Figure 22A:
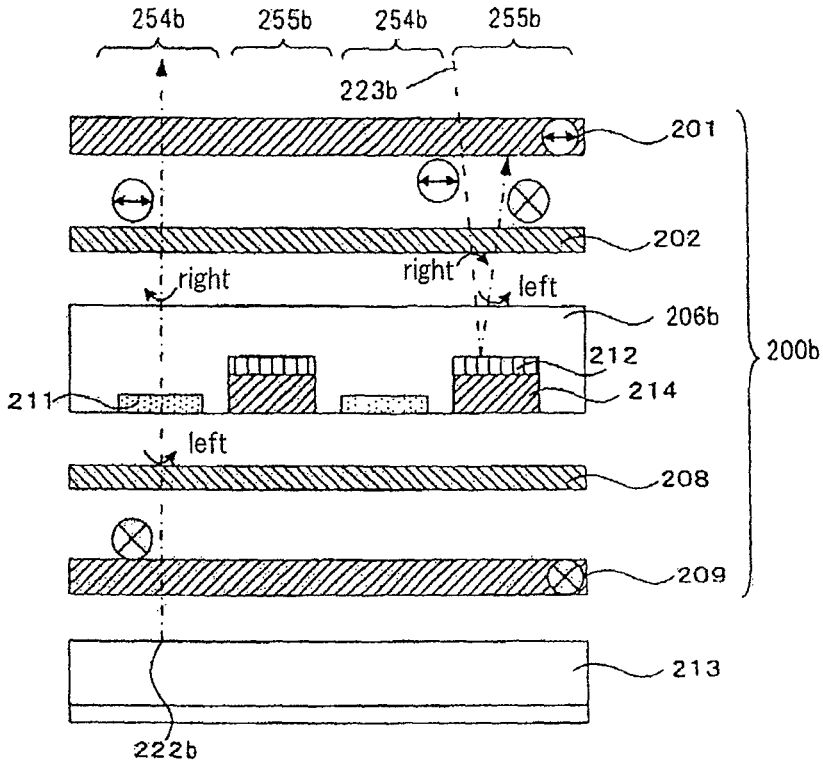
FIG. 22A is a schematic diagram indicating trajectories of light in the liquid crystal display device shown in FIG. 21.
Figure 22B:
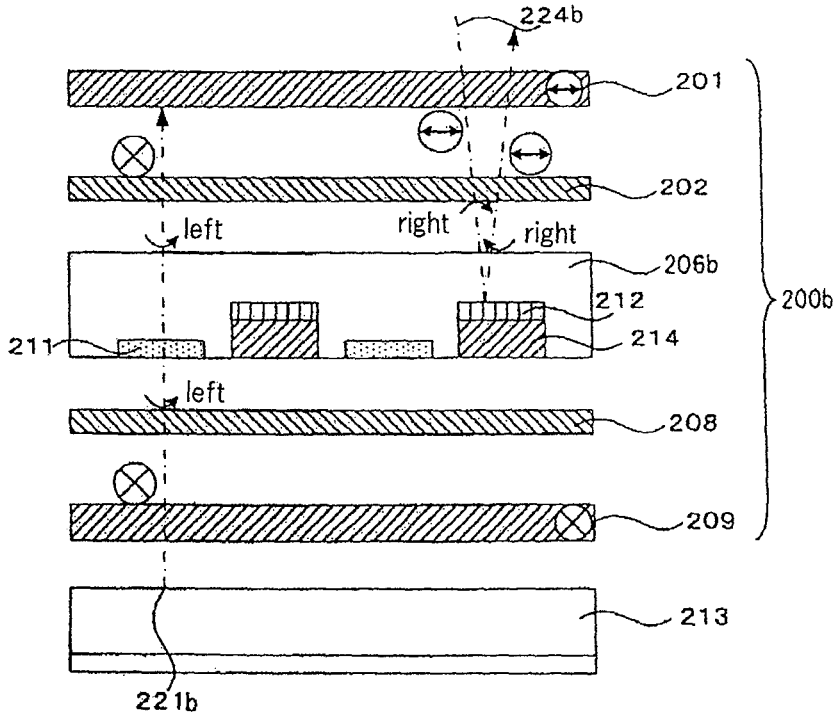
FIG. 22B is a schematic diagram indicating trajectories of light in the liquid crystal display device shown in FIG. 21.

Referring next to FIGS. 21, 22A, and 22B, a description will be given of a liquid crystal display device according to a fifth embodiment of the present invention. The liquid crystal display device of this embodiment is constructed in a manner similar to the liquid crystal display device according to the first embodiment except that it employs an ECB display scheme. FIGS. 21, 22A, and 22B correspond to FIGS. 6, 7A, and 7B in the first embodiment, where the same components are designated by the same reference numerals.

FIG. 21 is a cross-sectional view of the liquid crystal display device according to this embodiment. Liquid crystal panel 200*b* of this liquid crystal display device is provided with insulating layer 214 between lower substrate 207 and mirror sub-pixel electrode 212 for positioning a reflecting surface of mirror sub-pixel electrode 212 at the center of liquid crystal layer 206*b* in the thickness direction.

Also, the display scheme of this liquid crystal display device is the ECB scheme, where liquid crystal layer 206*b* includes liquid crystal molecules which are oriented in twisted alignment where they sequentially twist between substrates 930 and 950 by a value which is set in a range of zero to 90 degrees. In a non-voltage applied state where no voltage is applied between common electrode 205 and sub-pixel electrodes 211, 212, liquid crystal molecules are aligned in a direction parallel to substrates 203, 207 to give a phase difference of $\lambda/2$ to light which is transmited in the thickness direction. On the other hand, in a voltage applied state where a sufficient voltage is applied between common electrode 205 and sub-pixel electrodes 211, 212, liquid crystal layer 206*b* includes the liquid crystal molecules aligned in a direction perpendicular to substrates 203, 207 to give no phase difference to light which is transmited in the thickness direction.

FIG. 22A is a diagram showing trajectories of light in the display mode of this liquid crystal display device. In the display mode, arrow 222*b* indicates a trajectory of light irradiated to transmission sub-pixel 254*b* from back light 213. and arrow 223*b* indicates a trajectory of external light incident on mirror sub-pixel 255*b*.

In transmission sub-pixel 254*b* of this liquid crystal display device in the display mode, the absolute value of a voltage applied to liquid crystal layer 206*b* should be chosen to be equal to or higher than a voltage value at which transmission sub-pixel 254*b* enters a non-voltage applied state, i.e., 0 V or higher, and equal to or lower than a voltage value at which transmission sub-pixel 254*b* enters a voltage applied state. Also, in mirror sub-pixel 255*b* in the display mode, a predetermined voltage is applied to liquid crystal layer 206, so that mirror sub-pixel 255*b* is placed into a voltage applied state. FIG. 22A shows transmission sub-pixel 254*b* in a non-voltage applied state, by way of example.

As shown in FIG. 22A, in the display mode of this liquid crystal display device, light which has been transmitted through transmission sub-pixel 254*b* in an image display state is emitted from the front surface of liquid crystal panel 200*b*, while light reflected from mirror sub-pixel 255*b* in a non-mirror state is not emitted from the front surface of liquid crystal panel 200*b*.

FIG. 22B is a diagram which indicates a trajectory of light in the mirror mode of the liquid crystal display device. In the mirror mode, arrow 221*b* indicates a trajectory of light irradiated from back light 213 to transmission sub-pixel 254*b*, and arrow 224*b* indicates a trajectory of external light incident on mirror sub-pixel 255*b*.

In the mirror mode of this liquid crystal display device, transmission sub-pixel 254*b* is placed into a voltage applied state, while mirror sub-pixel 255*b* is placed into a non-voltage applied state.

As shown in FIG. 22B, in the mirror mode of this liquid crystal display device, light irradiated from back light 213 and incident on transmission sub-pixel 254*b* in a black display state is not emitted from the front surface of liquid crystal panel 200*b*, while light reflected by mirror sub-pixel 255*b* in a mirror state is emitted from the front surface of liquid crystal panel 200*b*.

(Sixth Embodiment)

Figure 23:
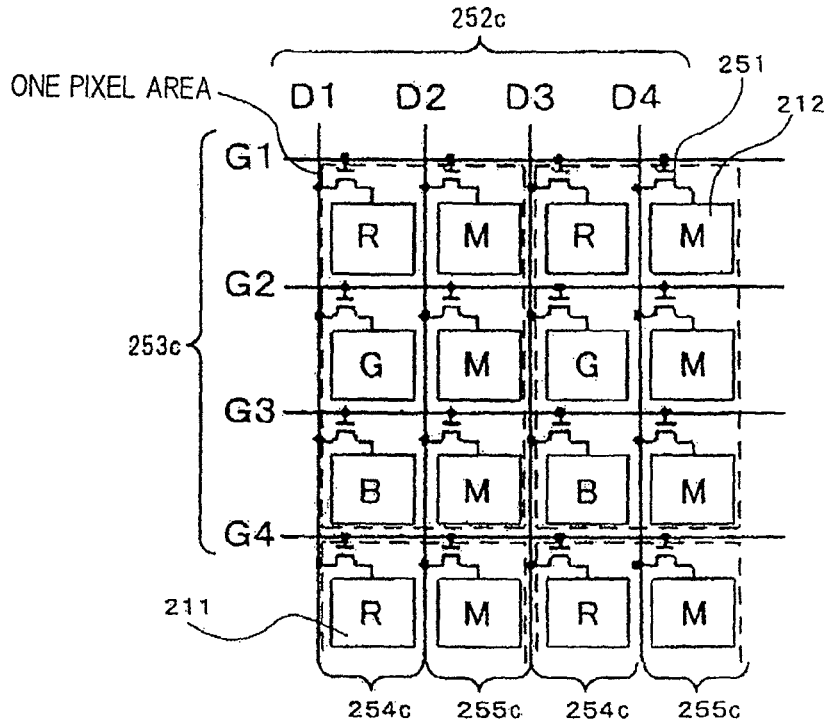
FIG. 23 is a schematic diagram showing the configuration of circuits in a liquid crystal display device according to a sixth embodiment of the present invention.

Referring next to FIG. 23, a description will be given of a liquid crystal display device according to a sixth embodiment of the present invention. The liquid crystal display device according to this embodiment is constructed in a manner similar to the liquid crystal display device according to the first embodiment except for components discussed below. FIG. 23 corresponds to FIG. 5 in the first embodiment, where the same components are designated by the same reference numerals.

In the liquid crystal display device according to the first embodiment, transmission sub-pixels 254 and mirror sub-pixels 255 form rows along gate lines 253, respectively, whereas in the liquid crystal display device according to this embodiment, transmission sub-pixels 254*c* and mirror sub-pixels 255*c* respectively form columns along drain lines 252*c*.

When sub-pixels 254*c*, 255*c* are arranged as they are in this liquid crystal display device, similar advantages to those of the liquid crystal display device according to the first embodiment can still be provided by executing control such that transmission sub-pixels 254*c* are placed into an image display state and mirror sub-pixels 255*c* are placed in a non-mirror state in the display mode, and executing control such that transmission sub-pixels 254*c* are placed in a black display state and mirror sub-pixels 255*c* are placed into a mirror state in the mirror mode.

(Seventh Embodiment)

Figure 24:
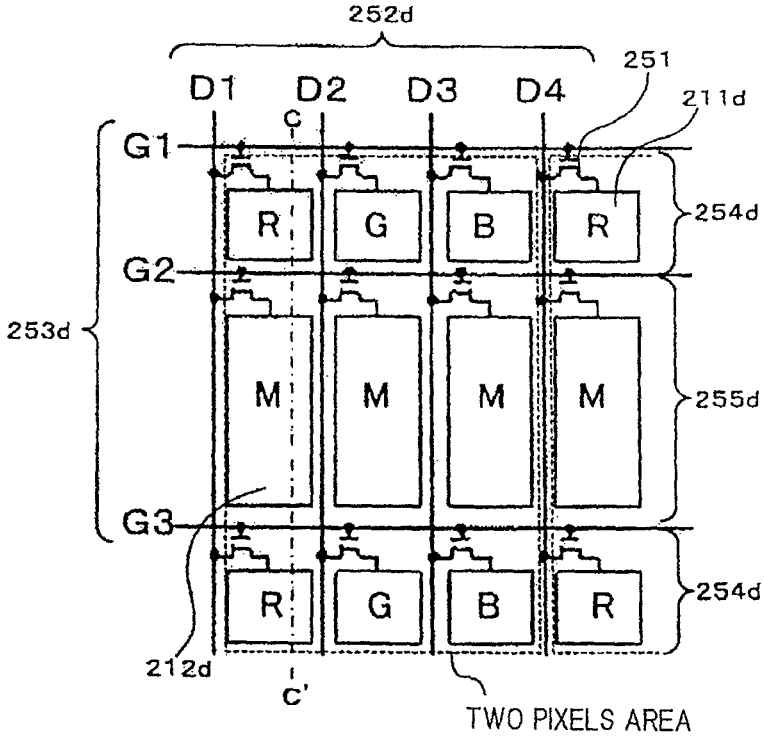
FIG. 24 is a schematic diagram showing the configuration of circuits in a liquid crystal display device according to a seventh embodiment of the present invention.
Figure 25:
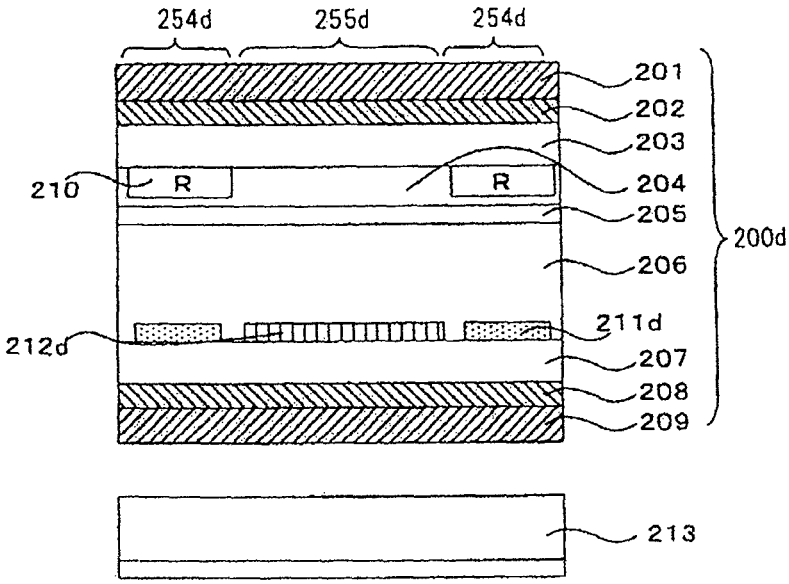
FIG. 25 is a cross-sectional view of the liquid crystal display device shown in FIG. 24, taken along line C-C'.

Referring next to FIGS. 24 and 25, a description will be given of a liquid crystal display device according to a seventh embodiment of the present invention. The liquid crystal display device according to this embodiment is constructed in a manner similar to the liquid crystal display device according to the first embodiment except for components discussed below. FIGS. 24 and 25 correspond to FIGS. 5 and 6 in the first embodiment, where the same components are designated by the same reference numerals.

FIG. 24 is a schematic diagram showing the configuration of circuits in the liquid crystal display device according to this embodiment, and FIG. 25 is a cross-sectional view of the liquid crystal display device shown in FIG. 24, taken along line C-C'.

Unlike the liquid crystal display device according to the first embodiment, this liquid crystal display device comprises mirror sub-pixel 255*d* which has a length in the column direction approximately twice as long as transmission sub-pixel 254*d*. Specifically, mirror sub-pixel 255*d* has a cross-sectional area parallel to the front surface of liquid crystal panel 200*d* approximately twice as large as transmission sub-pixel 254*d*. Further, sub-pixels 254*d*, 255*d* are arrayed to form rows in units of transmission sub-pixel 254*d*, mirror sub-pixel 255*d*, and transmission sub-pixel 254*d*.

Like the liquid crystal display device according to the first embodiment, this liquid crystal display device executes control to place transmission sub-pixels 254*d* into an image display state and mirror sub-pixels 255*d* into a non-mirror state in the display mode, and to place transmission sub-pixels 254*d* into a black display state and mirror sub-pixels 255*d* into a mirror state in the mirror mode.

Figure 1:
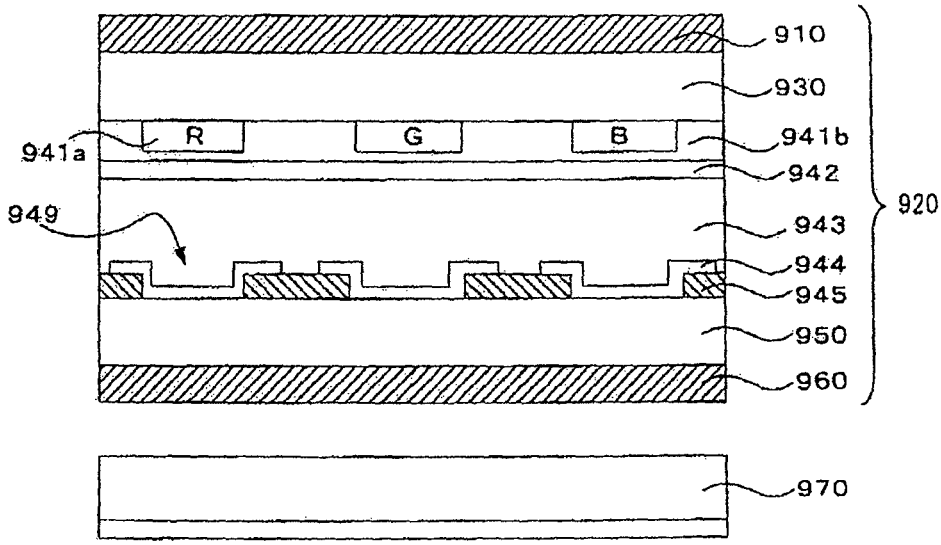
FIG. 1 is a cross-sectional view of a general transflective liquid crystal display device.
Figure 2:
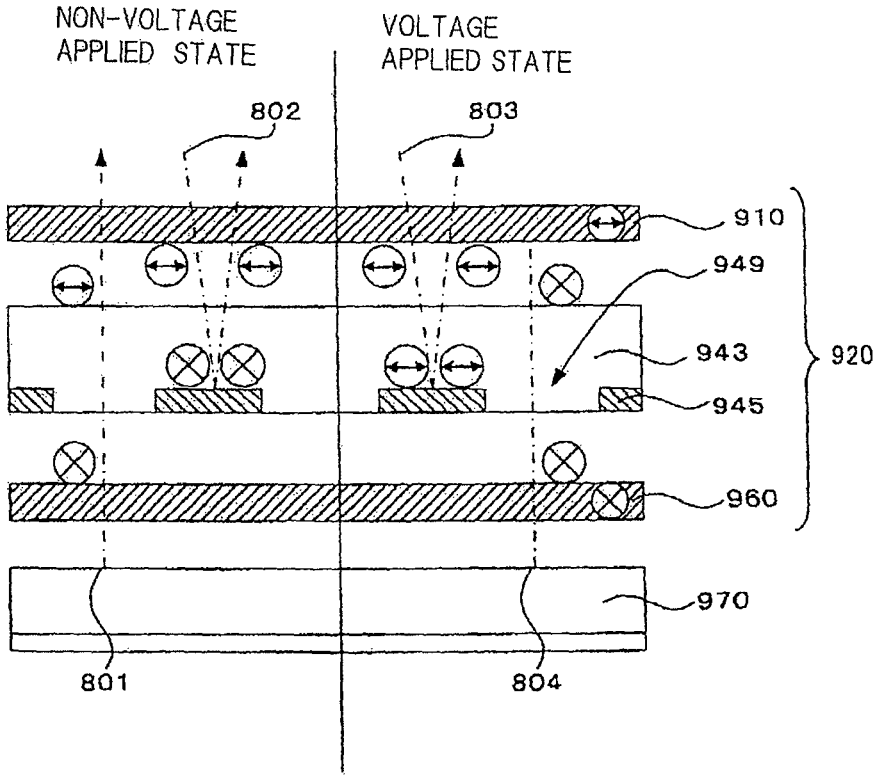
FIG. 2 is a schematic diagram indicating trajectories of light in the liquid crystal display device show in FIG. 1.
Figure 3:
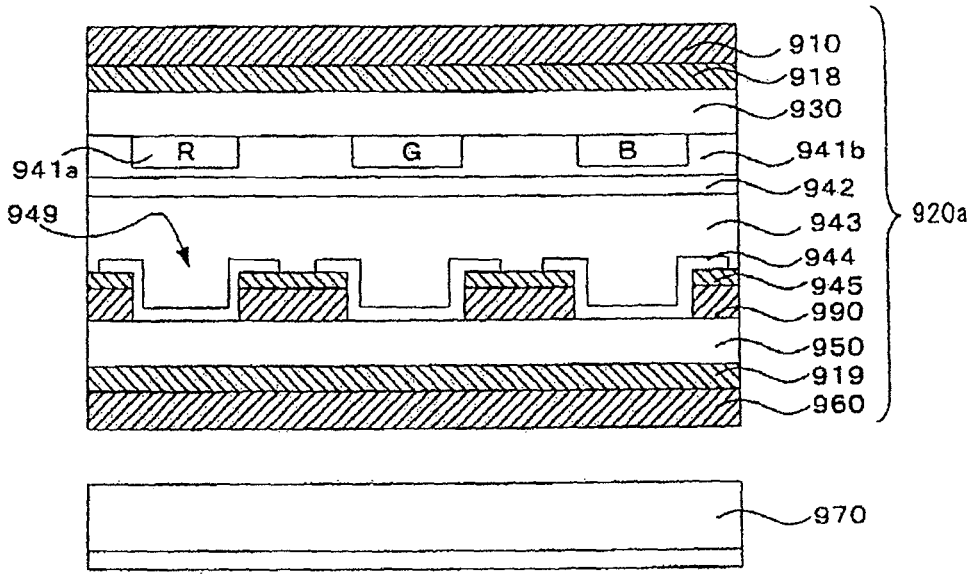
FIG. 3 is a cross-sectional view of a general transflective liquid crystal display device.
Figure 4:
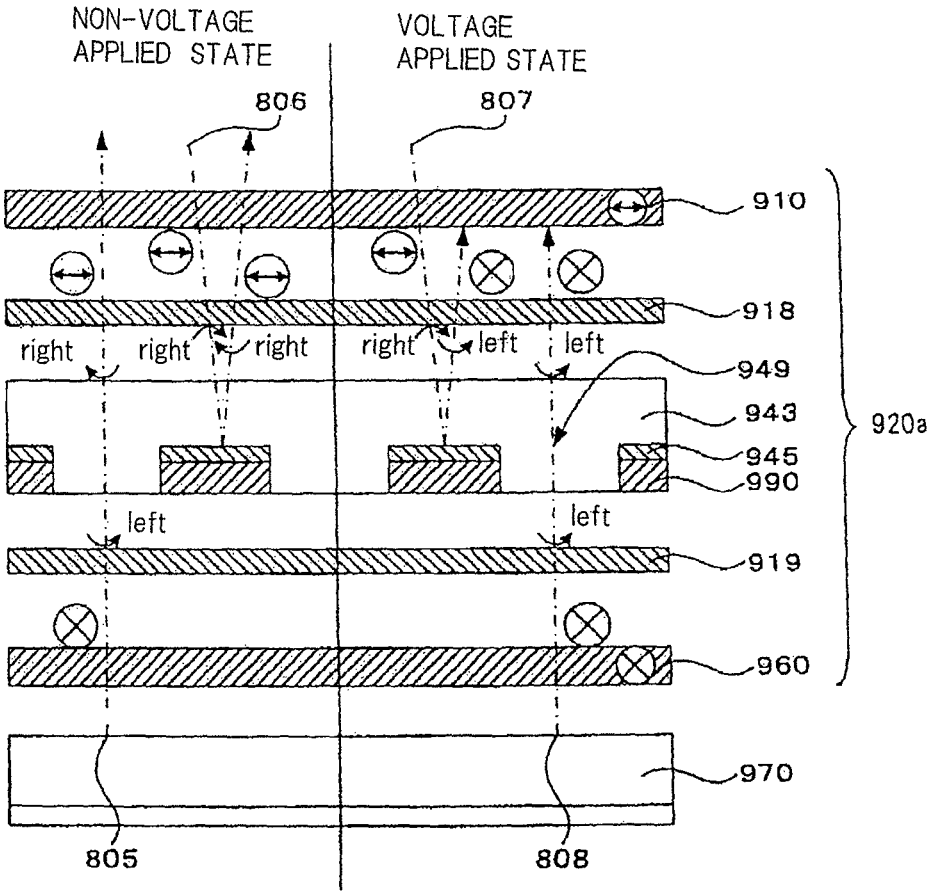
FIG. 4 is a schematic diagram indicating trajectories of light in the liquid crystal display device shown in FIG. 3.

In this liquid crystal display device two pixels are made up of six transmission sub-pixels 254*d* and three mirror sub-pixels 255*d* indicated by a broken line which surrounds them in FIG. 25. On the other hand, in the liquid crystal display device according to the first embodiment shown in FIG. 2, two pixels include six mirror sub-pixels. As such, the liquid crystal display device according to this embodiment includes a fewer number of mirror sub-pixels 255*d*, and, in association therewith, fewer numbers of mirror sub-pixel electrodes 212*d*, TFTs 251, and gate line 253*d* as well. Consequently, the liquid crystal display device according to this embodiment requires a fewer number of parts and can therefore simplify the driving scheme, and reduce the manufacturing cost.

Also, since the liquid crystal display device according to this embodiment includes fewer numbers of TFTs 251 and gate lines 253*d*, mirror sub-pixel electrodes 212*d* can be correspondingly increased in size. Accordingly, mirror sub-pixel electrodes 212*d* of the liquid crystal display device according to this embodiment can be increased in size twice as large as mirror sub-pixel electrodes 212 of the liquid crystal display device according to the first embodiment. With such an increased size, mirror sub-pixels 255*d* can reflect an increased amount of light in the mirror mode.

Also, since this liquid crystal display device comprises the same number of transmission sub-pixels as the liquid crystal display device according to the first embodiment, a high image quality can be ensured in the display mode as is the case with the liquid crystal display device according to the first embodiment.

The number of transmission sub-pixels 254*d* is twice the number of mirror sub-pixels 255*d* in this embodiment, but can be another integer multiple, in which case similar advantages to those of this embodiment can be provided by a resulting liquid crystal display device.

(Eighth Embodiment)

Referring next to FIGS. 26 to 29, a description will be given of a liquid crystal display device according to an eighth embodiment of the present invention. The liquid crystal display device according to this embodiment is constructed in a manner similar to the liquid crystal display device according to the first embodiment except for components discussed below. In the liquid crystal display device according to this embodiment, while transmission sub-pixels 254*e* are controlled in an active matrix scheme like the liquid crystal display device according to the first embodiment, mirror sub-pixels 255*e* are controlled in a static scheme.

Figure 26:
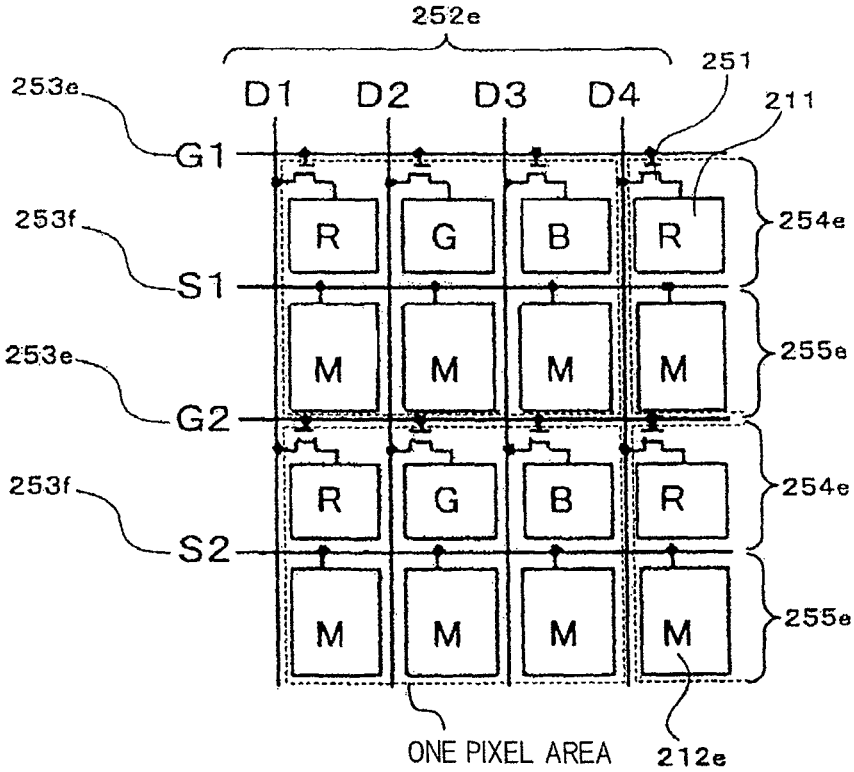
FIG. 26 is a schematic diagram showing the configuration of circuits in a liquid crystal display device according to an eighth embodiment of the present invention.

FIG. 26 is a schematic diagram showing the configuration of circuits in the liquid crystal display device according to this embodiment. FIG. 26 corresponds to FIG. 6 in the first embodiment, where the same components are designated by the same reference numerals. As shown in FIG. 26, since mirror sub-pixels 255*e* are driven in the static scheme in this liquid crystal display device, electrode wire 253*f* is directly connected to mirror sub-pixel 212*e*. Therefore, since TFT 251 is not provided in mirror sub-pixel 255*e* in this liquid crystal display device, mirror sub-pixel electrode 212*e* can be correspondingly increased in size. Consequently, mirror sub-pixel 255*e* can reflect an increased amount of light in the mirror mode.

Here, electrode wires 253*f* are labeled S1, S2, . . . , Sm, . . . , S(n−1), Sn in order from above in FIG. 26. In this liquid crystal display device, S1-S(m−1) and Sm-Sn can be applied with voltages different from each other. It is therefore possible to individually switch mirror sub-pixel electrodes 212*e* connected S1-S(m−1) and mirror sub-pixel electrodes 212*e* connected to Sm-Sn to a mirror state and a non-mirror state.

Figure 27A:
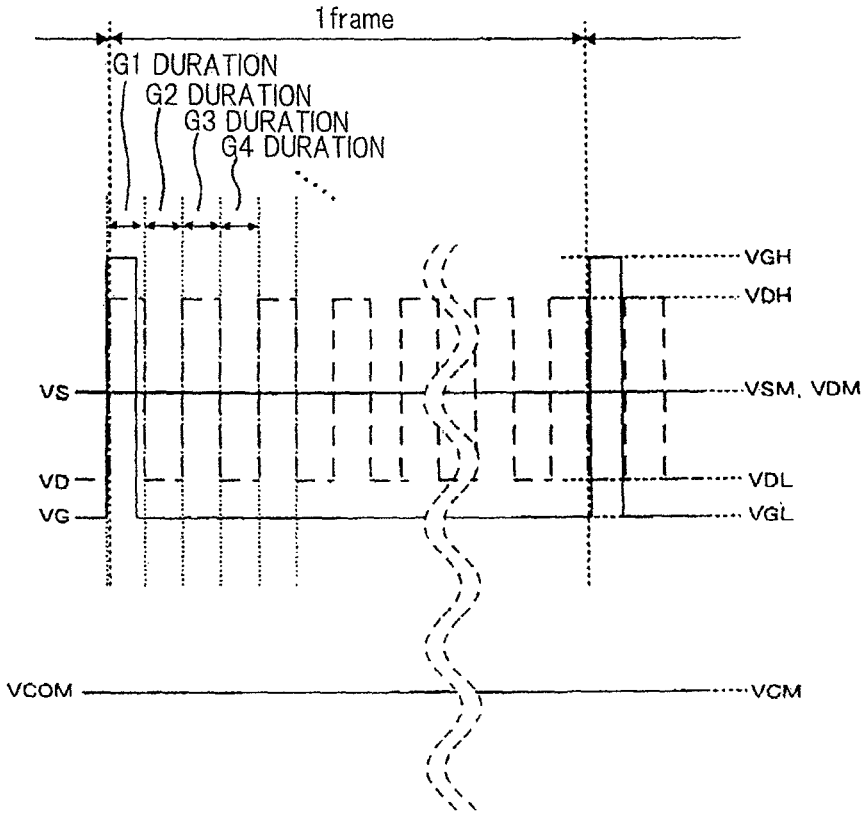
FIG. 27A is a diagram showing the waveforms of voltages applied to the liquid crystal display device shown in FIG. 26.
Figure 27B:
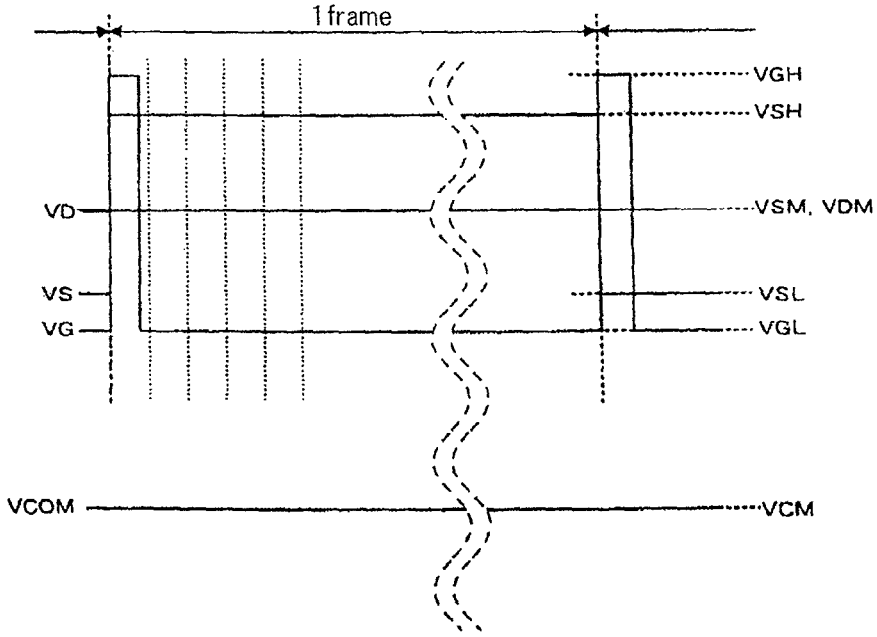
FIG. 27B is a diagram showing the waveforms of voltages applied to the liquid crystal display device shown in FIG. 26.

Referring next to FIGS. 27A and 27B, a description will be given of how to drive sub-pixels 254*e*, 255*e* of this liquid crystal display device. FIGS. 27A and 27B correspond to FIGS. 13A and 13B in the first embodiment. This liquid crystal display device employs a gate line inversion driving method for transmission sub-pixels 254*e*, but may otherwise employ, for example, a source line inversion drive, a dot inversion drive, a frame inversion drive, and the like.

Representations of G1 duration, G2 duration, . . . are used only for describing how to drive transmission sub-pixels 254*e* connected to gate line 253*e*. Voltage VS applied to electrode wires 253*f* is set to a constant value in one frame irrespective of the duration of gate lines 253*e*.

Referring first to FIG. 27A, a description will be given of a display mode of this liquid crystal display device. FIG. 27A shows the waveforms of voltages VG, VD, and VCOM applied to gate line 253*e*, drain line 252*e*, and common electrode 205, respectively, during G1 duration in the display mode.

The value of VG is set to VGH only during Gn duration for selecting a sub-pixel connected to each gate line 253 (Gn) and to VGL during the remaining durations. Specifically, the value of VG at G1 is VGH only during G1 duration, and VGL during the remaining durations.

VS has the value of VSM, and VCOM has the value of VCM. In this embodiment, VSM=VCM. The value of VD can be determined within a range of VCM or higher to VDH or lower during a duration (G1 duration, G3 duration, . . . ) for selecting transmission sub-pixels 254*e*, and can be determined in a range of VDL or higher to VCM or lower during a duration (G2 duration, G4 duration, . . . ) for selecting mirror sub-pixels 255*e*.

During G1 duration in the frame shown in FIG. 27A, a voltage having the value of (VD−VCM) is applied between transmission sub-pixel electrode 211*e* and common electrode 205 of transmission sub-pixel 254*e* connected to G1. Since the value of VD is equal to or higher than VCM in any transmission sub-pixel 254*e*, a voltage having the value of 0 V or higher should be applied between transmission sub-pixel electrode 211*e* and common electrode 205.

Accordingly, transmission sub-pixel 254*e* connected to G1 at this time is in an image display state. where a positive voltage can be applied between transmission sub-pixel electrode 211*e* and common electrode 205 by adjusting the value of VD.

During G2 duration in the frame shown in FIG. 27A, a voltage having the value of (VD−VCM) is applied between transmission sub-pixel electrode 211*e* and common electrode 205 of transmission sub-pixel 254*e* connected to G1. Since the value of VD is equal to or higher than VCM in any transmission sub-pixel 254*e*, a voltage having the value of 0 V or lower should be applied between transmission sub-pixel electrode 211*e* and common electrode 205.

Accordingly, transmission sub-pixel 254*e* connected to G1 at this time is in an image display state, where a negative voltage can be applied between transmission sub-pixel electrode 211*e* and common electrode 205 by adjusting the value of VD.

Also, during Gn duration in the frame shown in FIG. 27A, a positive voltage or a negative voltage can be applied between transmission sub-pixel electrode 211*e* and common electrode 205 as well in transmission sub-pixels 254*e* connected to gate line 253 (Gn) other than G1 and G2. Accordingly, any of transmission sub-pixels 254*e* connected to Gn at this time is in an image display state. Further, any of transmission sub-pixels 254*e* connected to Gn are likewise in an image display state during Gn duration in frames other than that shown in FIG. 27A.

In the frame shown in FIG. 27A, the value of VS is VSM which is equal to VCM, i.e., the value of VCOM in mirror sub-pixel 255*e* connected to any electrode wire 253*f*. Accordingly, a voltage having the value of 0 V is applied between mirror sub-pixel electrode 212*e* and common electrode 205. Since any one of mirror sub-pixels 255*e* is placed into a non-voltage applied state, this one sub-pixel presents a non-mirror state.

This liquid crystal display device can place transmission sub-pixels 254*e* into an image display state and mirror sub-pixels 255*e* into a non-mirror state by driving sub-pixels 254*e*, 255*e* in the foregoing manner. In this way, this liquid crystal display device can realize the display mode.

Referring next to FIG. 27B, a description will be given of the mirror mode of this liquid crystal display device. FIG. 27B shows the waveforms of voltages VG, VD, and VCOM applied to gate line 253*e*, drain line 252*e*, and common electrode 205, respectively, during G1 duration in the mirror mode.

The value of VG is set to VGH only during Gn duration for selecting a sub-pixel connected to each gate line 253 (Gn) and to VGL during the remaining durations. Specifically, the value of VG at G1 is VGH only during G1 duration, and VGL during the remaining durations.

VD has the value of VDM, while VCOM has the value of VCM. In this embodiment, VDM=VCM. VS takes the values of VSH and VSL which alternate every frame. Specifically, VS has the value of VDH in the frame shown in FIG. 27B, and the value of VSL in the next frame. In this embodiment, VSH=VCH, and VSL=VCL.

During G1 duration in the frame shown in FIG. 27B, the value of VD is VDM which is equal to VCM, i.e., the value of VCOM in transmission sub-pixel 254*e* connected to G1. Accordingly, a voltage having the value of 0 V is applied between transmission sub-pixel electrode 211*e* and common electrode 205. Since transmission sub-pixels 254*e* is placed into a non-voltage applied state, it presents a black display state.

Likewise, during Gn duration in all frames, transmission sub-pixels 254*e* connected to Gn are placed into a non-voltage applied state because the value of VD is equal to the value of VCOM, and therefore present a black display state.

In the frame shown in FIG. 27B, a voltage having the value of (VS−VCM) is applied between mirror sub-pixel electrode 212*e* and common electrode 205 of mirror sub-pixel 255*e* connected to electrode wire 253*f*. Since VS has the value of VSH in any mirror sub-pixel 255*e*, a voltage having the value of (VSH−VCM) is applied between mirror sub-pixel electrode 212*e* and common electrode 205. In this event, mirror sub-pixels 255*e* present a mirror state because a positive voltage is being applied between mirror sub-pixel electrode 212*e* and common electrode 205, which brings mirror sub-pixels 255*e* into a voltage applied state.

In a frame next to that shown in FIG. 27B, a voltage having the value of (VD−VSM) is applied between mirror sub-pixel electrode 212*e* and common electrode 205 of mirror sub-pixel 255*e* connected to electrode wire 253*f*. Since VD has the value of VDL in any mirror sub-pixel 255*e*, a voltage having the value of (VDL−VCH) is applied between mirror sub-pixel electrode 212*e* and common electrode 205. In this event, mirror sub-pixels 255*e* present a mirror state because a negative voltage is applied between mirror sub-pixel electrode 212*e* and common electrode 205, which brings mirror sub-pixels 255*e* into a voltage applied state.

This liquid crystal display device can place transmission sub-pixels 254*e* into a black display state and mirror sub-pixels 255*e* into a mirror state by driving sub-pixels 254*e*, 255*e* in the foregoing manner. In this way, this liquid crystal display device can realize the mirror mode.

Figure 28:
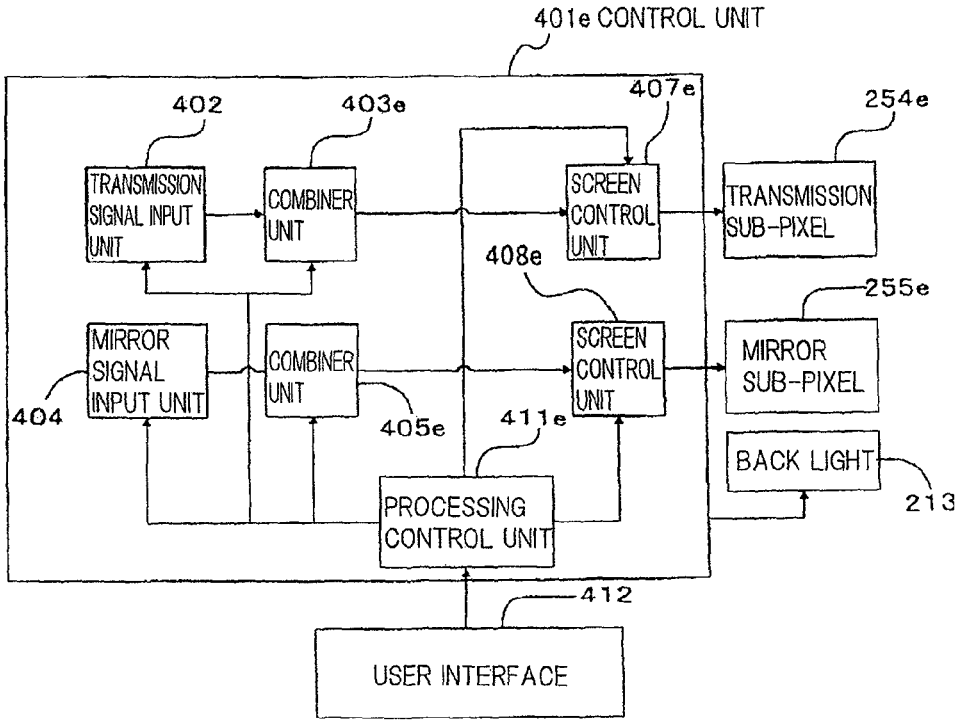
FIG. 28 is a block diagram showing a screen control function in the liquid crystal display device shown in FIG. 26.
Figure 29:
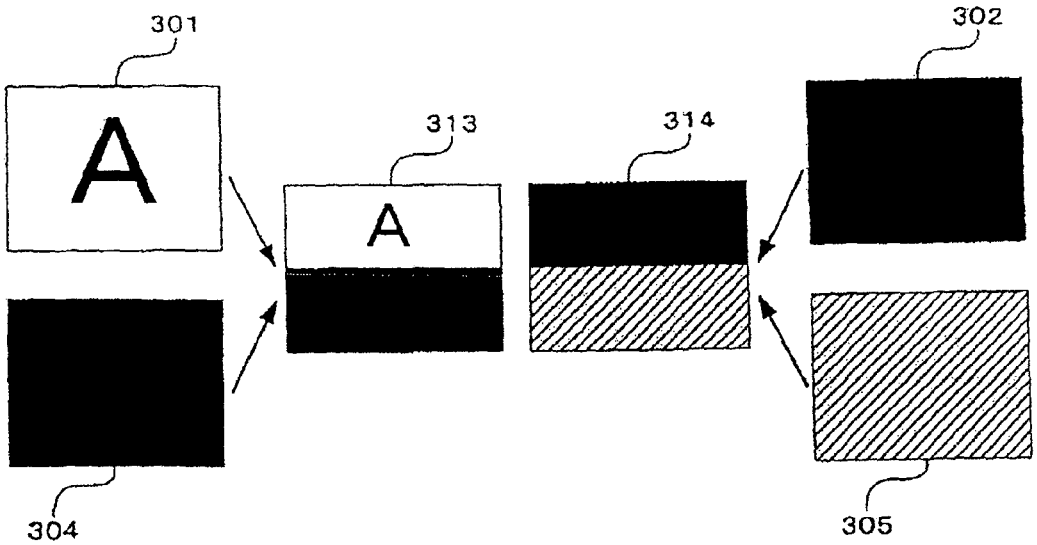
FIG. 29 is a diagram showing a screen control process in the liquid crystal display device shown in FIG. 26.

Referring next to FIGS. 28 and 29, a description will be given of a screen control function of the liquid crystal display device according to this embodiment. The liquid crystal display device according to this embodiment is constructed in a manner similar to the liquid crystal display device according to the first embodiment except for control unit 401*e*. FIGS. 28 and 29 correspond to FIGS. 9 and 10 in the first embodiment, where the same components are designated by the same reference numerals.

FIG. 28 is a block diagram showing a screen control function of the liquid crystal display device, and FIG. 29 shows an example of a screen control process in accordance with the screen control function of FIG. 28. FIG. 29 shows a screen control process in the screen mode shown in FIG. 8D, as an example of the screen control.

Unlike the liquid crystal display device according to the first embodiment, this liquid crystal display device comprises control unit 401*e* which is provided with screen control unit 407*e* for controlling transmission sub-pixels 254*e*, and screen control unit 408*e* for controlling mirror sub-pixels 255*e*. Additionally, this liquid crystal display device is not provided with combiner unit 406 for combining transmission sub-pixel information 313 with mirror sub-pixel information 314.

Combiner unit 403*e* combines image display information 301 and black display information 304 applied thereto from display signal input unit 402 to form transmission sub-pixel information 313. Combiner unit 405*e* in turn combines non-mirror information 302 and mirror information 305 applied thereto from mirror signal input unit 404 to form mirror sub-pixel information 314.

Then, combiner unit 403*e* sends transmission sub-pixel information 313 to mirror control unit 407*e*, such that screen control unit 407*e* drives transmission sub-pixels 254*e* in accordance with transmission sub-pixel information 313. Combiner unit 405*e* in turn sends mirror sub-pixel information 314 to screen control unit 408*e*, such that screen control unit 408*e* drives mirror sub-pixels 255*e* in accordance with mirror sub-pixel information 314.

Figure 30:
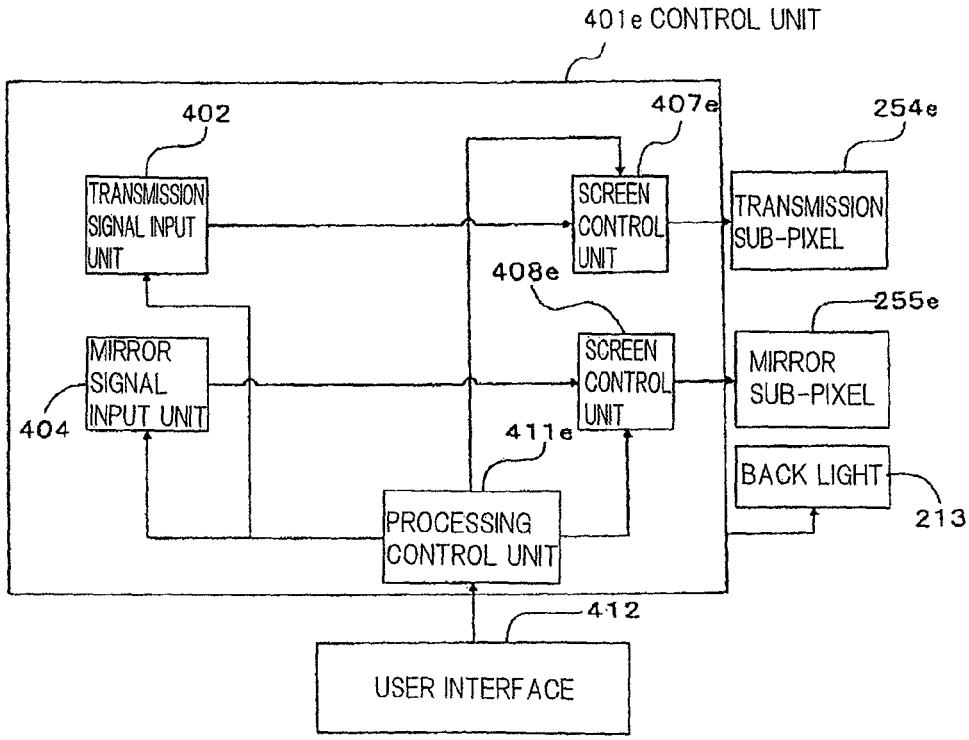
FIG. 30 is a diagram showing an exemplary modification to the screen control in the liquid crystal display device shown in FIG. 26.

Alternatively, control unit 401*e* may not comprise combiner units 403*e*, 405*e*, as shown in FIG. 30. In this event, screen control unit 407*e* drives transmission sub-pixels 254*e* in accordance with image display information 301 and black display information 304 applied thereto from display signal input unit 402 and with a transmission position signal applied thereto from processing control unit 411*e*. Screen control unit 408*e*, in turn, drives mirror sub-pixels 255*e* in accordance with non-mirror information 302 and mirror information 305 applied thereto from mirror signal input unit 404 and with a mirrors position signal applied thereto from processing control unit 411*e*.

(Ninth Embodiment)

Figure 31:
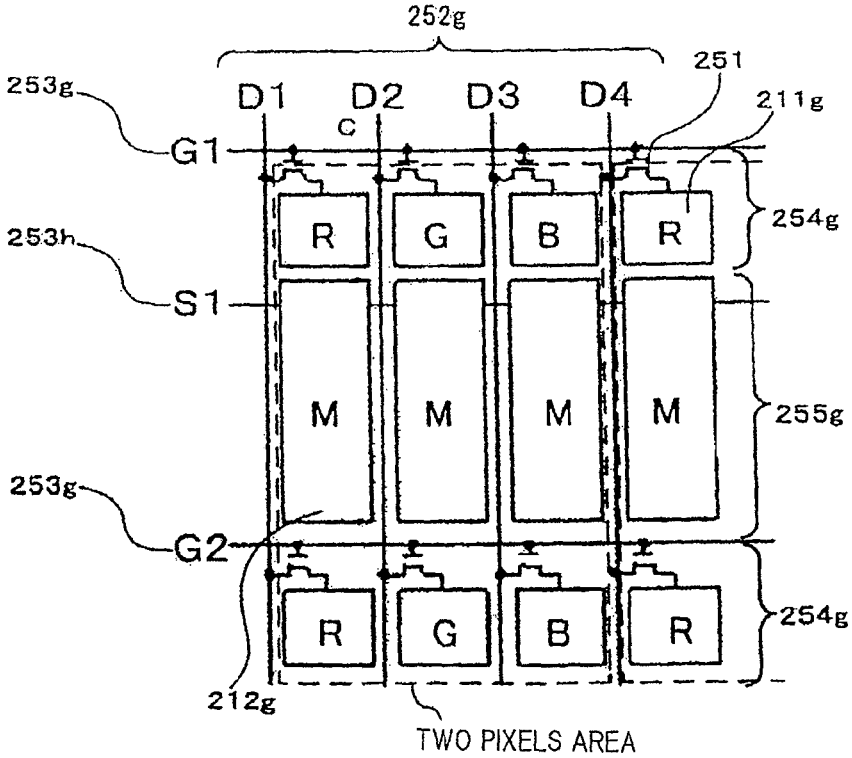
FIG. 31 is a schematic diagram showing the configuration of circuits in a liquid crystal display device according to a ninth embodiment of the present invention.

Referring next to FIG. 31, a description will be given of a liquid crystal display device according to a ninth embodiment of the present invention. The liquid crystal display device according to this embodiment is constructed in a manner similar to the liquid crystal display device according to the first embodiment except for components discussed below. FIG. 31 corresponds to FIG. 5 in the first embodiment, where the same components are designated by the same reference numerals.

Like the liquid crystal display device according to the seventh embodiment shown in FIG. 24, this liquid crystal display device comprises mirror sub-pixels 255*g* which have a length in the column direction that is approximately twice as long as that of transmission sub-pixels 254*g*. Further, sub-pixels 254*g*, 255*g* are arrayed to form rows in units of transmission sub-pixel 254*g*, mirror sub-pixel 255*g*, and transmission sub-pixel 254*g*.

This liquid crystal display device controls mirror sub-pixels 255*g* in accordance with a passive matrix scheme. Therefore, in this liquid crystal display device, mirror sub-pixel 255*g* need not be provided with TFT 251, so that mirror sub-pixel electrode 212*g* can be correspondingly increased in size more than the liquid crystal display device according to the seventh embodiment shown in FIG. 24. With the increased size, mirror sub-pixel 255*g* can reflect a more increased amount of light in the mirror mode.

(Tenth Embodiment)

Figure 32:
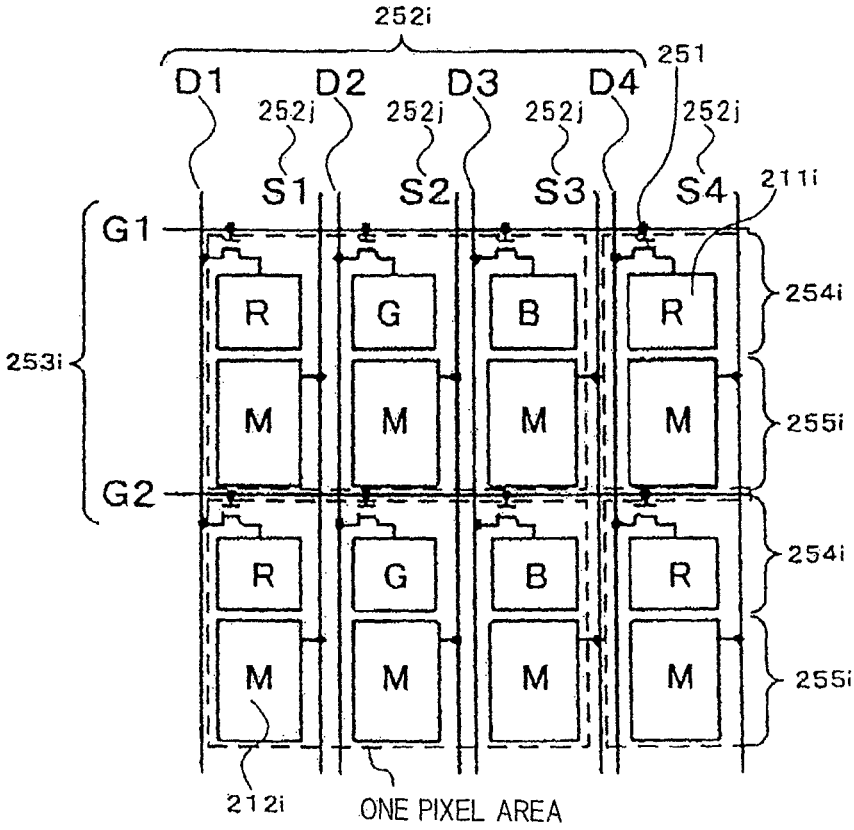
FIG. 32 is a schematic diagram showing the configuration of circuits in a liquid crystal display device according to a tenth embodiment of the present invention.

Referring next to FIG. 32, a description will be given of a liquid crystal display device according to a tenth embodiment of the present invention. The liquid crystal display device according to this embodiment is constructed in a manner similar to the liquid crystal display device according to the first embodiment except for components discussed below. FIG. 32 corresponds to FIG. 5 in the first embodiment, where the same components are designated by the same reference numerals.

Unlike the liquid crystal display device according to the first embodiment, this liquid crystal display device controls mirror sub-pixels 255*i* in accordance with a passive matrix scheme. Therefore, in this liquid crystal display device, mirror sub-pixel 255*i* need not be provided with TFT 251, so that mirror sub-pixel electrode 212*i* can be correspondingly increased in size more than the liquid crystal display device according to the first embodiment. With the increased size, mirror sub-pixel 255*i* can reflect a greater increased amount of light in the mirror mode.

Notably, when electrode wires 252*j* are arranged in parallel to drain lines 252*i*, as they are in this liquid crystal display device, sub-pixels 254*i*, 255*i* can be driven in a manner similar to the liquid crystal display device according to the ninth embodiment.

Figure 33:
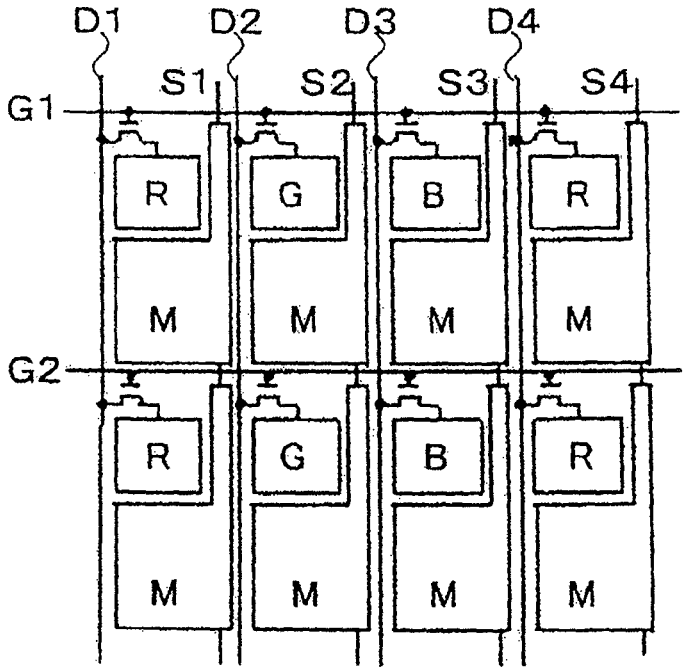
FIG. 33 is a schematic diagram showing the configuration of circuits in a liquid crystal display device according to an exemplary modification to the tenth embodiment of the present invention.

Also, as shown in FIG. 33, transmission sub-pixel electrode 211*i* and mirror sub-pixel electrode 212*i* may be modified in shape, such that modified areas are occupied by transmission sub-pixel 254*i* and mirror sub-pixel 255*i*.

(Eleventh Embodiment)

Referring next to FIGS. 34 through 36B, a description will be given of a liquid crystal display device according to an eleventh embodiment of the present invention. The liquid crystal display device according to this embodiment is constructed in a manner similar to the liquid crystal display device according to the first embodiment except for components discussed below.

Figure 34:
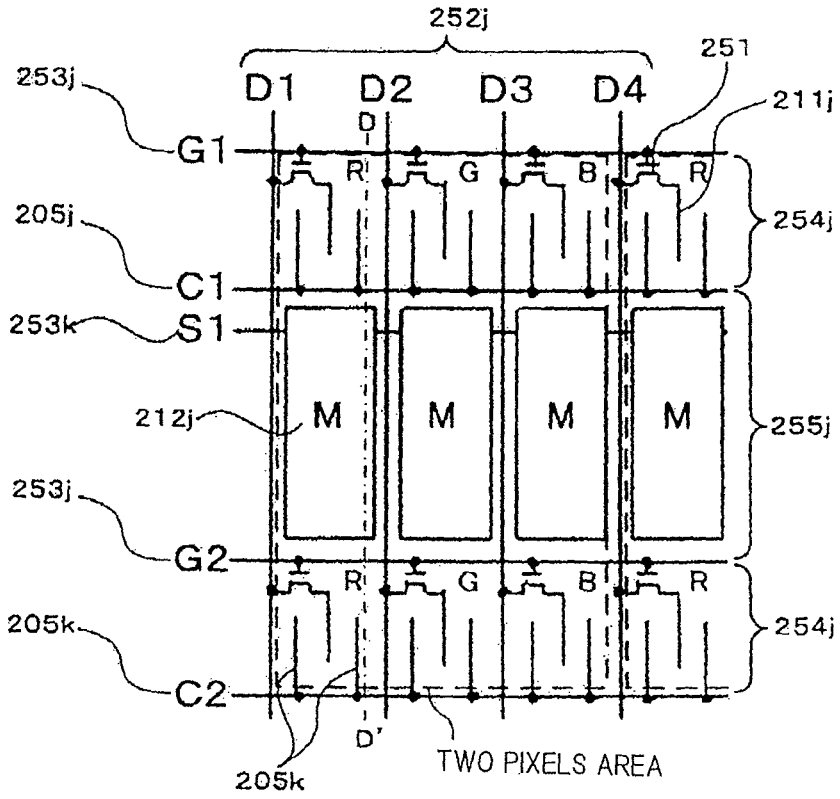
FIG. 34 is a schematic diagram showing the configuration of circuits in a liquid crystal display device according to an eleventh embodiment of the present invention.

FIG. 34 is a schematic diagram showing the configuration of circuits in the liquid crystal display device according to this embodiment. FIG. 34 corresponds to FIG. 5 in the first embodiment, where the same components are designated by the same reference numerals.

In this liquid crystal display device, transmission sub-pixels 254*j* are controlled in an IPS scheme, while mirror sub-pixels 255*j* are controlled in an ECB scheme. Transmission sub-pixel 254*j* is provided with comb-shaped transmission sub-pixel electrode 211*j* and comb-shaped common electrode 205*k*. Each common electrode 205*k* is connected to common electrode wire 205*k*. Liquid crystal layer 206*j* is such that liquid crystal molecules are aligned in a direction parallel to substrates 930, 905 when no voltage is applied between common electrode 205*k* and transmission sub-pixel electrode 211*j*.

Figure 35:
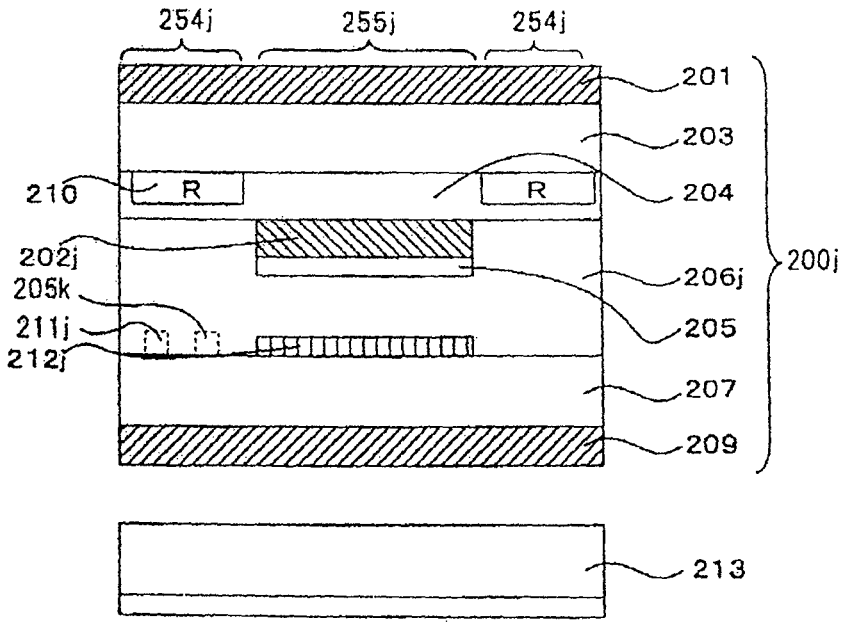
FIG. 35 is a cross-sectional view of the liquid crystal display device shown in FIG. 34, taken along line D-D'.

FIG. 35 is a cross-sectional view of the liquid crystal display device shown in FIG. 34, taken along line D-D'. FIG. 35 corresponds to FIG. 6 in the first embodiment, where the same components are designated by the same reference numerals. Notably, common electrode 205*k* is conceptually illustrated in FIG. 35, and an actual arrangement of common electrode 205*k* is different from that shown in FIG. 35.

Transmission sub-pixel 254*j* is not provided with a λ/4 plate, and transmission sub-pixel electrode 211*j* and common electrode 205*k* are disposed on the top surface of lower substrate 207. While mirror sub-pixel 255*j* is not provided with a λ/4 plate on the top surface of upper substrate 203 or on the bottom surface of lower substrate 207, internal λ/4 plate 202*j* is disposed between protection film 204 and common electrode 205. The bottom surface of common electrode 205 is positioned at the center of liquid crystal layer 206*j* in the thickness direction.

Figure 36A:
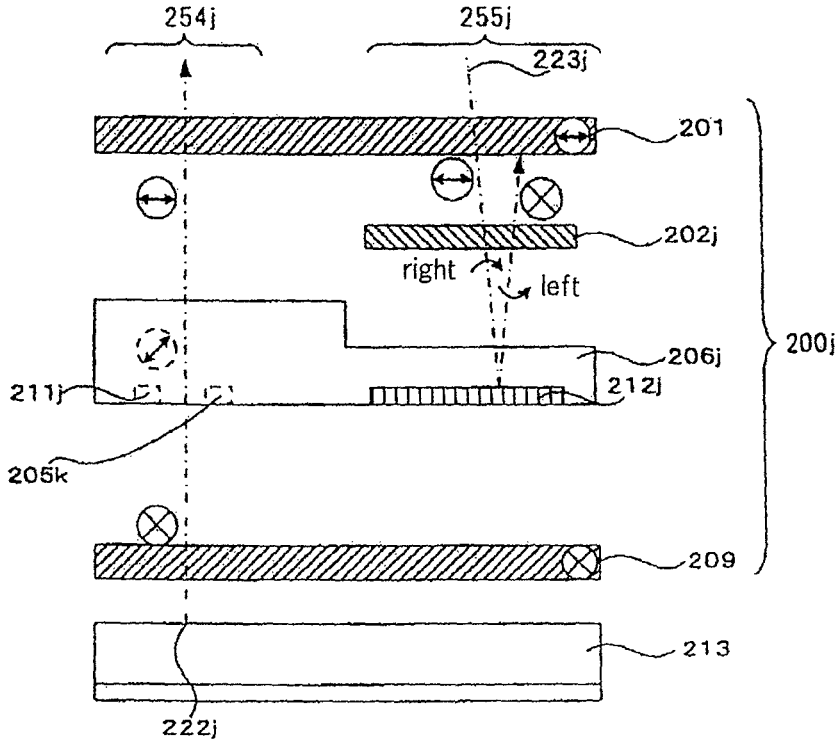
FIG. 36A is a diagram showing the waveforms of voltages applied to the liquid crystal display device shown in FIG. 34.
Figure 36B:
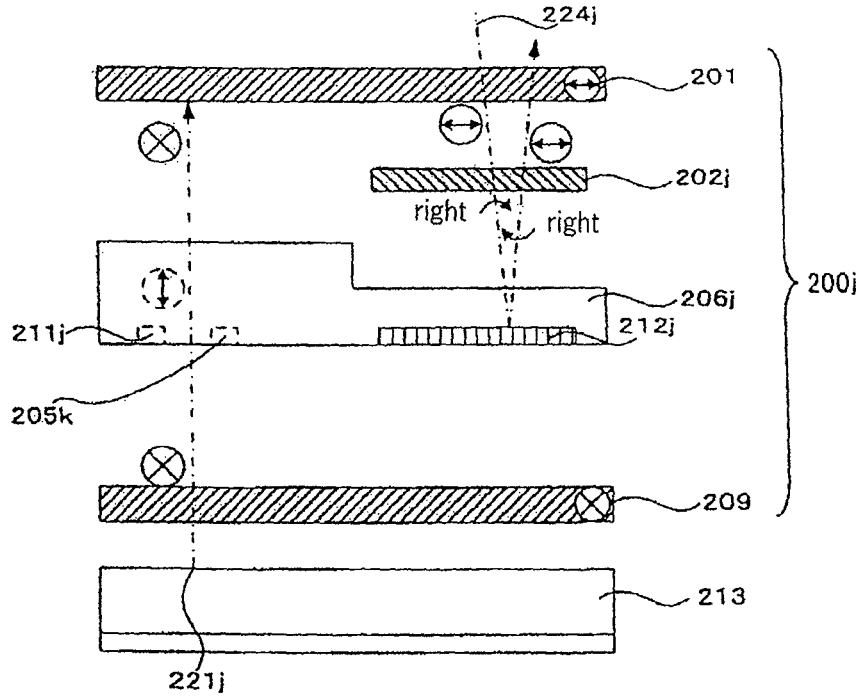
FIG. 36B is a diagram showing the waveforms of the voltages applied to the liquid crystal display device shown in FIG. 34.

FIG. 36A is a diagram which indicates trajectories of light in the display mode of this liquid crystal display device. FIGS. 36A and 36B correspond to FIGS. 7A and 7B in the first embodiment, where the same components are designated by the same reference numerals. An arrow encircled by a broken circle, drawn in liquid crystal layer 206*j* in FIG. 36A indicates an alignment axis of the liquid crystal layer, when viewed from an observer in a direction normal to the surface of polarizer plate 201*j*.

In transmission sub-pixel 254*j* in the display mode of this liquid crystal display device, the absolute value of a voltage applied to liquid crystal layer 206*j* should be chosen to be equal to or higher than a voltage value at which transmission sub-pixel 254*j* enters a non-voltage applied state, i.e., 0 V or higher, and equal to or lower than a voltage value at which transmission sub-pixel 254*j* enters a voltage applied state. In the display mode, in turn, no voltage is applied to liquid crystal layer 206*j* such that mirror sub-pixel 254*j* is placed into a non-voltage applied state. FIG. 36A shows that transmission sub-pixel 254*j* is in the voltage applied state, by way of example. The alignment axis of liquid crystal layer 206*j* runs in a direction perpendicular to the drawing sheet of FIG. 36 in the non-voltage applied state, and the alignment axis of liquid crystal layer 206*j* rotates by 45 degrees in a direction parallel to an in-plane direction of polarizer plate 209 in the voltage applied state of transmission sub-pixel 254*j*.

Arrow 222*j* indicates a trajectory of light irradiated from back light 213 toward transmission sub-pixel 254*j* in a voltage applied state in the display mode. In this embodiment, a phase difference of λ/2 is given to light which is transmitted through liquid crystal layer 206*j* in transmission sub-pixel 254*j* in the voltage applied state. The polarization direction of the light rotates due to the polarization direction of the light incident on liquid crystal layer 206*j* and the angle of the alignment axis of liquid crystal layer 206*j*.

Linearly polarized light, which has been transmitted through polarizer plate 209 and is traveling in a polarization direction perpendicular to the drawing sheet, is transmitted through liquid crystal layer 206 and is given a phase difference of λ/2 with a delay phase axis inclined by 45 degrees, resulting in linearly polarized light traveling in a polarization direction parallel to the drawing sheet. This linearly polarized light is transmitted through polarizer plate 201 because its polarization direction matches with the orientation of the polarization transmission axis of polarizer plate 201.

In this way, in the display mode of this liquid crystal display device, transmission light which has been irradiated from back light 213 and which has been by transmitted transmission sub-pixel 254*j* can be placed into an image display state where the light can be allowed to exit from the front surface of liquid crystal panel 200*j*.

Also, arrow 223*j* indicates a trajectory of external light which is incident on mirror sub-pixel 255*j* in a non-voltage applied state in the display mode. In this embodiment, no phase difference is given to light which is transmitted through liquid crystal layer 206*j* in mirror sub-pixel 255*j* in a voltage applied state.

Linearly polarized light which has been transmitted through polarizer plate 201 and is traveling in a polarization direction parallel to the drawing sheet, is transmitted through internal λ/4 plate 202*j* to transform itself into right-hand circularly polarized light which is incident on liquid crystal layer 206*j*. The right-hand circularly polarized light, incident on liquid crystal layer 206*j*, is not given a phase difference by liquid crystal layer 206*j* which is applied with voltage and aligned vertically, when the right-hand circularly polarized light is reflected by mirror sub-pixel electrode 212*j* so that is transmitted through liquid crystal layer 206*j* back and forth. However, right-hand circularly polarized light is reflected by mirror sub-pixel electrode 212*j*, with its polarity inverted, resulting in left-hand circularly polarized light. This left-hand circularly polarized light is transmitted through internal λ/4 plate 202*j* which transforms the same into linearly polarized light traveling in the polarization direction perpendicular to the drawing sheet. This linearly polarized light is not transmitted through polarizer plate 201 because its polarization direction differs from the orientation of the polarization transmission axis of polarizer plate 201 by 90 degrees.

In this way, in the display mode of this liquid crystal display device, light incident on the front surface of liquid crystal panel 200*j* and reflected by mirror sub-pixel electrode 212*j* can be placed into a non-mirror state, where the reflected light is not allowed to exit from the front surface of liquid crystal panel 200*j*, by placing mirror sub-pixel 255*j* into a voltage applied state.

As described above, in the display mode of this liquid crystal display device, display sub-pixel 254*j* is placed into an image display state, while mirror sub-pixel 255*j* is placed into a non-mirror state, thereby allowing only the light which has been transmitted through transmission sub-pixel 254*j* to exit from the front surface of liquid crystal panel 200*j*, and not allowing the light reflected from mirror sub-pixel 255*j* to exit.

FIG. 36B is a diagram which indicates the trajectories of light in the mirror mode of this liquid crystal display device. In the mirror mode of this liquid crystal display device, transmission sub-pixel 254*j* and mirror sub-pixel 255*j* are placed into a non-voltage applied state.

Arrow 221*j* indicates a trajectory of light irradiated from back light 213 toward transmission sub-pixel 254*j* in a non-voltage applied state in the mirror mode. In this embodiment, since the alignment axis of liquid crystal layer 206*j* in transmission sub-pixel 254*j* in the non-voltage applied state is parallel to the polarization direction of light 221*j* incident on liquid crystal layer 206*j*, light which has been transmitted through liquid crystal layer 206*j* does not change in polarization state.

Linearly polarized light traveling in the polarization direction perpendicular to the drawing sheet, which has been transmitted through polarizer plate 209, is transmitted through liquid crystal layer 206*j* without any change in polarization state added thereto. This linearly polarized light is not transmitted through polarizer plate 201 because its polarization direction is different from the orientation of polarization transmission axis of polarizer plate 201 by 90 degrees.

In this way, in the mirror mode of this liquid crystal display device, transmission sub-pixel 254*j* is placed into a non-voltage applied state, thereby bringing transmission sub-pixel 254*j* into a black display state where light irradiated from back light 213 is not allowed to exit from the front surface of liquid crystal panel 200.

Also, arrow 224*j* indicates a trajectory of external light which is incident on mirror sub-pixel 255*j* in a voltage applied state in the mirror mode. In this embodiment, a phase difference of λ/4 is given to light which is transmitted through liquid crystal layer 206*j* of transmission sub-pixel 254*j* in a non-voltage applied state.

Linearly polarized light traveling in parallel to the drawing sheet, which has transmitted polarizer plate 201, is transmitted through internal λ/4 plate 202*j* which transforms the same into a right-hand circularly polarized light which is then incident on liquid crystal layer 206*j*. The right-hand circularly polarized light incident on liquid crystal layer 206*j* is given a phase difference of λ/4 by liquid crystal layer 206*j*, when it impinges on mirror sub-pixel electrode 212*j*, resulting in linearly polarized light. This linearly polarized light is reflected by mirror sub-pixel electrode 212*j*, while it remains to be linearly polarized light, and then is transmitted through liquid crystal layer 206*j* which gives a phase difference of λ/4 to the linearly polarized light, resulting in right-hand circularly polarized light. This right-hand circularly polarized light is transmitted through λ/4 plate 202*j*, resulting in linearly polarized light traveling in a polarization direction parallel to the drawing sheet. This linearly polarized light is transmitted through polarizer plate 201 because its polarization direction matches the orientation of the polarization transmission axis of polarizer plate 201.

In this way, this liquid crystal display device can place mirror sub-pixel 255*j* into a non-voltage applied state in the mirror mode, thereby setting the same into a mirror state where light incident from the front surface of liquid crystal panel 200*j* and reflected by mirror sub-pixel electrode 212*j* is allowed to exit from the front surface of liquid crystal panel 200*j*.

As described above, in the mirror mode of this liquid crystal display device, display sub-pixel 254*j* is placed into a black display state, while mirror sub-pixel 255*j* is placed into a mirror state, thereby allowing only reflected light from mirror sub-pixel 255*j* to exit from the front surface of liquid crystal panel 200*j*, without preventing light irradiated from back light 213 and incident on transmission sub-pixel 254*j* from being emitted.

Notably, in this liquid crystal display device, transmission sub-pixel 254*j* is driven in accordance with a normally black driving scheme which does not allow light irradiated from back light 213 to exit from the front surface of liquid crystal panel 200*j* in a non-voltage applied state, while mirror sub-pixel 255*j* is driven in a normally white driving scheme which allows external light reflected by mirror sub-pixel electrode 212*j* to exit from the front surface of liquid crystal panel 200*j* in the non-voltage applied state. In other words, since the screen of the liquid crystal display device remains in a mirror state at all times when no power is supplied, the liquid crystal display device can be used as a mirror even when it is powered off, and can also demonstrate high decorativeness.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A liquid crystal display device comprising:

a liquid crystal panel including a plurality of transmission sections and a plurality of mirror sections;

a light source for directing light irradiated thereby into said liquid crystal panel; and a control unit for controlling said transmission sections and said mirror sections, wherein each of said transmission sections is connected to gate lines through a switching device, and can be switched between an image display state which can allow the irradiated light to exit and a black display state which does not allow the irradiated light to exit, wherein each of said mirror sections is directly connected to electrode wires extending parallel to said gate lines, without passing through said switching device, and includes a reflection member having a flat surface, and can be switched between a mirror state which can allow incident light reflected by said reflection member to exit, and a non-mirror state which does not allow the reflected light to exit, independently of said transmission section, wherein the number of said mirror sections is fewer than the number of said transmission sections, and the area of each of said mirror sections is more than or equal to twice the area of each of said transmission sections, and the number of said electrode wires is fewer than the number of the gate lines, and wherein said control unit places each of said transmission sections into either the image display state or the black display state, and places each of said mirror sections into either the minor state or the non-mirror state.

2. The liquid crystal display device according to claim 1, further comprising a switching device disposed near an intersection of each of a plurality of scanning lines each having a plurality of signal lines and each controlled by a signal applied to the scanning line, wherein said signal line and said transmission section are connected through said switching device, and said signal line and said mirror section are directly connected.

3. The liquid crystal display device according to claim 2, wherein said transmission section is driven in accordance with a normally black operation scheme, and said minor section is driven in accordance with a normally white operation scheme.

4. The liquid crystal display device according to claim 1, wherein said transmission section is driven in accordance with a normally black operation scheme, and said minor section is driven in accordance with a normally white operation scheme.

5. The liquid crystal display device according to claim 1, wherein said transmission section is driven in accordance with a normally black operation scheme, and said minor section is driven in accordance with a normally white operation scheme.

6. The liquid crystal display device according to claim 1, wherein said control unit sets a screen into a display mode by placing said mirror section into the non-mirror state and placing said transmission section into an image display state, and sets the screen into a minor mode by placing said minor section into the minor state and placing said transmission section into the black display state, in accordance with a mode switching signal.

7. The liquid crystal display device according to claim 6, wherein said control unit is capable of setting a first area of the screen into the display mode, and setting a second area of the screen so that it is different from the first area into the minor mode.

8. An electronic device comprising:

the liquid crystal display device according to claim 7, and an input unit for applying a mode switching signal to a control unit of said liquid crystal display device, wherein said mode switching signal is applied to said control unit through said input unit.

9. An electronic device comprising:

the liquid crystal display device according to claim 6, and an input unit for applying a mode switching signal to a control unit of said liquid crystal display device, wherein said mode switching signal is applied to said control unit through said input unit.

* * * * *